US012454887B2

(12) United States Patent
Poitzsch et al.

(10) Patent No.: US 12,454,887 B2
(45) Date of Patent: Oct. 28, 2025

(54) USING ARTIFICIAL INTELLIGENCE METHODS TO EXPLOIT WELL LOGGING DATA

(71) Applicant: SAUDI ARABIAN OIL COMPANY, Dhahran (SA)

(72) Inventors: Martin E. Poitzsch, Northumberland, NH (US); Chicheng Xu, Houston, TX (US); Shouxiang Ma, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/788,947

(22) Filed: Jul. 30, 2024

(65) Prior Publication Data

US 2025/0043681 A1 Feb. 6, 2025

Related U.S. Application Data

(60) Provisional application No. 63/516,754, filed on Jul. 31, 2023.

(51) Int. Cl.
*E21B 49/00* (2006.01)

(52) U.S. Cl.
CPC ..... *E21B 49/005* (2013.01); *E21B 2200/20* (2020.05); *E21B 2200/22* (2020.05)

(58) Field of Classification Search
CPC . E21B 49/005; E21B 2200/20; E21B 2200/22
See application file for complete search history.

(56) References Cited

U.S. PATENT DOCUMENTS 9,828,845 B2 * 11/2017 Kpetehoto ..... E21B 44/02
9,970,266 B2 * 5/2018 Marx ..... E21B 7/00
11,299,975 B2 * 4/2022 Harvey ..... E21B 44/00
11,459,882 B2 * 10/2022 Kharaa ..... E21B 49/00
(Continued)

FOREIGN PATENT DOCUMENTS

WO 2008/106603 A1 9/2008
WO WO-2020082824 A1 * 4/2020 ..... G06F 18/214

OTHER PUBLICATIONS

Foreign Reference (Year: 2020).*
(Continued)

*Primary Examiner* — Kenneth L Thompson
(74) *Attorney, Agent, or Firm* — Osha Bergman Watanabe & Burton LLP

(57) ABSTRACT

A method for constructing a high fidelity logging while drilling (LWD) log that includes obtaining a temporal well depth log and a plurality of temporal LWD logs from a drilling operation. The method further includes obtaining a temporal record of operational drilling parameters from the drilling operation. The method further includes determining, using a first machine-learning model, a temporal history of the drilling operation and constructing, using the temporal well depth log and the plurality of temporal LWD logs, a plurality of temporal property logs at each depth in the plurality of depths. The method further includes processing the plurality of temporal property logs with, at least, a second machine-learning model to form a plurality of corrected temporal property logs and aggregating the plurality of corrected temporal property logs to form a plurality of high fidelity LWD logs.

20 Claims, 13 Drawing Sheets

(56) References Cited

U.S. PATENT DOCUMENTS

| | | | | |
|---|---|---|---|---|
| 11,821,857 | B2 * | 11/2023 | Krumm | G01N 23/223 |
| 12,241,369 | B2 * | 3/2025 | Yamada | G06T 7/40 |
| 2018/0238148 | A1 * | 8/2018 | Canady | G01V 11/002 |
| 2020/0040719 | A1 * | 2/2020 | Maniar | E21B 41/00 |
| 2022/0075915 | A1 | 3/2022 | Vallabhaneni et al. | |
| 2022/0268144 | A1 | 8/2022 | Al-Abduljabbar | |
| 2023/0068373 | A1 | 3/2023 | Zhang | |
| 2023/0084947 | A1 | 3/2023 | Mahiout et al. | |
| 2024/0328308 | A1 * | 10/2024 | Lee | E21B 47/12 |
| 2024/0368983 | A1 * | 11/2024 | Ayadiuno | E21B 49/003 |

OTHER PUBLICATIONS

International Search Report issued in corresponding International Application No. PCT/US2024/040328; mailed Nov. 6, 2024 (6 pages).

Written Opinion of the International Searching Authority issued in corresponding International Application No. PCT/US2024/040328; dated Nov. 6, 2024 (6 pages).

* cited by examiner

USING ARTIFICIAL INTELLIGENCE METHODS TO EXPLOIT WELL LOGGING DATA

BACKGROUND

Oil and gas extraction from subsurface rock formations requires drilling of wells using drilling rigs mounted on the ground surface or offshore rig platforms. While drilling, logging while drilling (LWD) tools may be used to measure properties of the subsurface rock formations. Typically, LWD logs are transmitted to the surface at regular intervals using a telemetry method. LWD logs may be processed to, among other things, determine subsurface lithology, guide the direction of drilling, and identify and avoid drilling hazards.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein generally relate to a method for constructing a high fidelity logging while drilling (LWD) log based on the temporal history of a drilling operation and the entirety of the an LWD tool memory. The method includes obtaining a temporal well depth log and a plurality of temporal logging while drilling (LWD) logs from a drilling operation, wherein the drilling operation includes a drill bit traversing through a subsurface at a plurality of depths and obtaining a temporal record of operational drilling parameters from the drilling operation. The method further includes determining, using a first machine-learning model, a temporal history of the drilling operation, wherein the first machine-learning model accepts, at least in part, the temporal well depth log and the temporal record of operational drilling parameters. The method further includes constructing, using the temporal well depth log and the plurality of temporal LWD logs, a plurality of temporal property logs at each depth in the plurality of depths, wherein each temporal property log includes a plurality of data points. The method further includes identifying and removing outlier data points from each of the temporal property logs based on the temporal history and processing the plurality of temporal property logs with, at least, a second machine-learning model to form a plurality of corrected temporal property logs. The method further includes aggregating the plurality of corrected temporal property logs to form a plurality of high fidelity LWD logs and determining a lithology of the subsurface using, at least in part, the plurality of high fidelity LWD logs.

Embodiments disclosed herein generally relate to a non-transitory computer-readable memory comprising computer-executable instructions stored thereon that, when executed on a processor, cause the processor to perform the following steps. The steps include receiving a temporal well depth log and a plurality of temporal logging while drilling (LWD) logs from a drilling operation, wherein the drilling operation includes a drill bit traversing through a subsurface at a plurality of depths and receiving a temporal record of operational drilling parameters from the drilling operation. The steps further include determining, using a first machine-learning model, a temporal history of the drilling operation, wherein the first machine-learning model accepts, at least in part, the temporal well depth log and the temporal record of operational drilling parameters and constructing, using the temporal well depth log and the plurality of temporal LWD logs, a plurality of temporal property logs at each depth in the plurality of depths, wherein each temporal property log comprises a plurality of data points. The steps further include identifying and removing outlier data points from each of the temporal property logs based on the temporal history and processing the plurality of temporal property logs with, at least, a second machine-learning model to form a plurality of corrected temporal property logs. The steps further include aggregating the plurality of corrected temporal property logs to form a plurality of high fidelity LWD logs and determining a lithology of the subsurface using, at least in part, the plurality of high fidelity LWD logs.

Embodiments disclosed herein generally relate to a system that includes a well site performing a drilling operation, where the drilling operation comprises a drill bit traversing through a subsurface, a plurality of logging while drilling (LWD) tools configured to measure properties of the subsurface, and a temporal record of operational drilling parameters of the well site. The system further includes a temporal well depth log and a plurality of temporal LWD logs, one for each LWD tool, where each temporal LWD log includes measurements of an associated property of the subsurface over a period of time. The system further includes a first machine-learning model, a second machine-learning model, and a computer with one or more computer processors and a non-transitory computer-readable memory storing computer-executable instructions that when executed on the one or more computer processors cause the one or more compute processors to perform the following steps. The steps include: receiving the temporal well depth log and the plurality of temporal logging while drilling (LWD) logs; receiving the temporal record of operational drilling parameters; and determining, using the first machine-learning model, a temporal history of the drilling operation, where the first machine-learning model accepts, at least in part, the temporal well depth log and the temporal record of operational drilling parameters. The steps further include: constructing, using the temporal well depth log and the plurality of temporal LWD logs, a plurality of temporal property logs at each depth in the plurality of depths, where each temporal property log comprises a plurality of data points; identifying and removing outlier data points from each of the temporal property logs based on the temporal history; and processing the plurality of temporal property logs with, at least, the second machine-learning model to form a plurality of corrected temporal property logs. The steps further include: aggregating the plurality of corrected temporal property logs to form a plurality of high fidelity LWD logs; and determining a lithology of the subsurface using, at least in part, the plurality of high fidelity LWD logs.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "acoustic signal" includes reference to one or more of such acoustic signals.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

Figure 1:
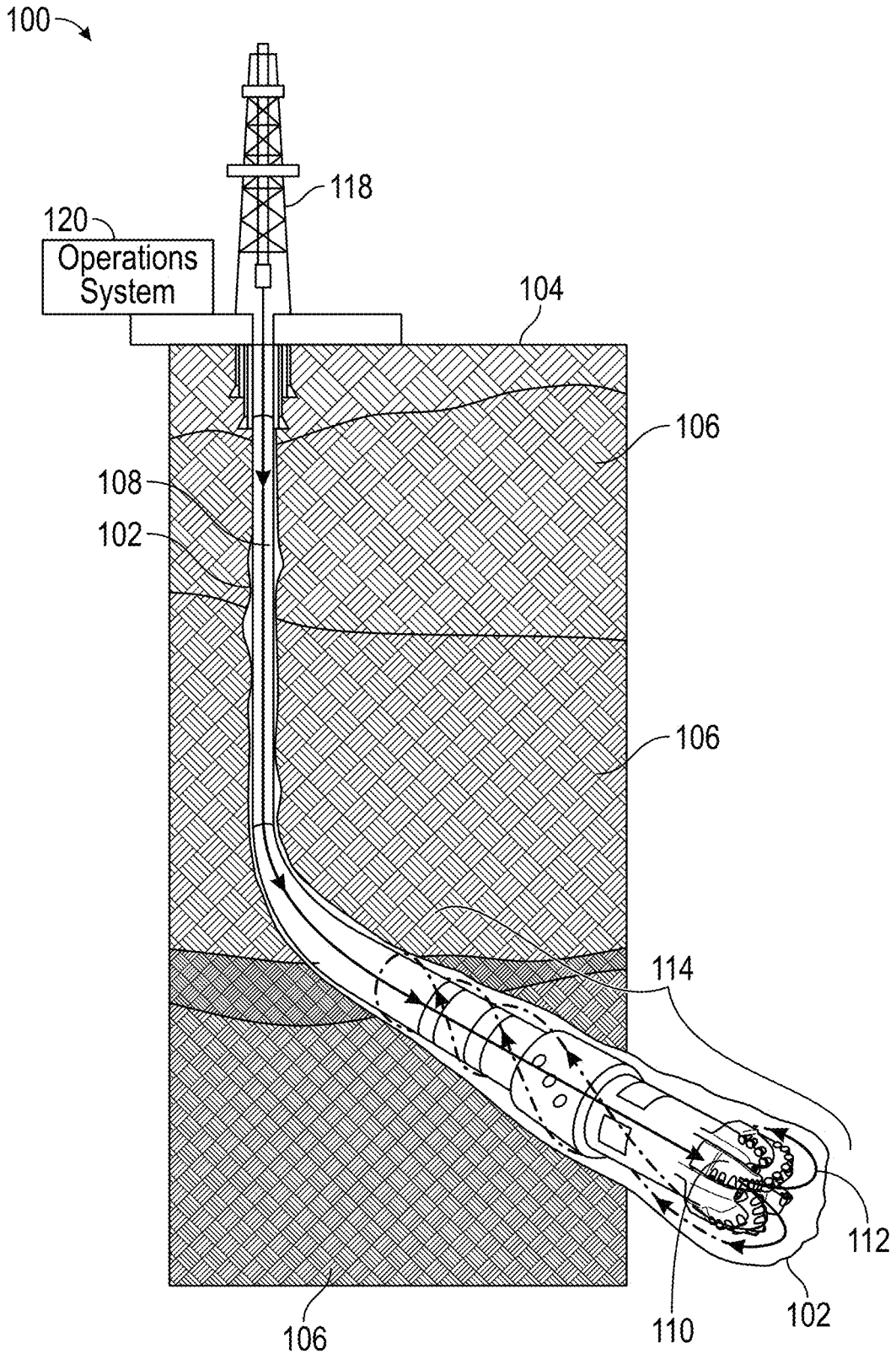
FIG. 1 depicts an example well site and drilling operations, in accordance with one or more embodiments.

FIG. 1 illustrates an example well site (100). A well site (100) may be used to extract oil and gas, generally referred to as hydrocarbons, from underground reservoirs. In general, well sites may be configured in a myriad of ways. Therefore, the well site (100) is not intended to be limiting with respect to a particular configuration of the drilling equipment. The well site (100) is depicted as being on land. In other examples, the well site (100) may be offshore, and drilling may be carried out with or without use of a marine riser. Further, FIG. 1 is focused on subsurface activities during a drilling operation. A drilling operation at well site (100) may include drilling a wellbore (102) into a subsurface including various formations (106). The subsurface formations (106) may be categorized by various formation properties of interest, such as formation porosity, formation permeability, resistivity, density, water saturation, total organic content and the like. Based on its properties, a subsurface formation (106) may be categorized according to a lithology, such as sandstone or shale. Further, subsurface formation (106) properties may be used to estimate reservoir parameters such as mineralogy, porosity, mobility and permeability, hydrocarbon saturation, and water saturation.

For the purpose of drilling a new section of wellbore (102), a drill string (108) is suspended within the wellbore (102). The drill string (108) may include one or more drill pipes connected to form conduit and a bottom hole assembly (BHA) (114) disposed at the distal end of the conduit. The BHA (114) may include a drill bit (110) to cut into the subsurface rock. The drill string (108) may be suspended in a wellbore (102) by a derrick (118). A crown block may be mounted at the top of the derrick (118), and a traveling block may hang down from the crown block by means of a cable or drilling line. One end of the cable may be connected to a draw works, which is a reeling device that may be used to adjust the length of the cable so that the traveling block may move up or down the derrick (118). The traveling block may include a hook on which a top drive is supported.

The top drive is coupled to the top of the drill string (108) and is operable to rotate the drill string (108). Alternatively, the drill string (108) may be rotated by means of a rotary table on the drilling floor. Drilling fluid (112) (commonly called mud) may be stored in a mud pit (not shown), and at least one pump may pump the mud from the mud pit into the drill string (108). The mud may flow into the drill string (108) through appropriate flow paths in the top drive (or a rotary swivel if a rotary table is used instead of a top drive to rotate the drill string (108)).

While cutting rock with a drill bit (110), typically, the drilling fluid (112) is circulated (with a pump) through the drill string (108), out of the drilling fluid nozzle of the drill bit (110), and back to the surface (104) through the presumably annular space between the wellbore (102) and the drill string (108). To guide the drill bit (110), monitor the drilling process, and collect data about the subsurface formations (106), among other objectives, the BHA (114) of the drill string (108) may be outfitted with "logging while drilling" (LWD) tools, "measurement while drilling" (MWD) tools, and a telemetry module. An MWD or LWD tool is generally a collection of sensors and hardware (measuring devices), where each sensor records a sensed property or downhole drilling parameter in an associated log during the drilling process. The measurements may be transmitted to the surface using any suitable telemetry system known in the art.

The BHA (114) and the drill string (108) may include other drilling tools known in the art but not specifically shown. Additionally, MWD and LWD logs may be recorded while drilling and stored on onboard tool memory. By means of example, common logs, or information collected by LWD devices, may include, but are not limited to, the density of the subsurface formations (106), the porosity of the subsurface formations (106), and temperature.

Typically, throughout the entire period of a drilling operation, the parameters measured by the LWD logging tools are recorded with respect to time in their respective tool memories. Upon returning to the surface, LWD logs may be retrieved from their respective tool memories to generate high resolution recorded-mode LWD well logs. Additionally, while drilling, coarser real-time LWD logs are also generated at the surface by a LWD engineer using a subsampled set of data that is telemetered to the surface with telemetry such as hydraulic mud-pulse or other means.

In some implementations, an operations system (120) may be disposed at or communicate with the well site (100). Operations system (120) may be configured to monitor and control at least a portion of a drilling operation at the well site (100) by providing controls to various components of the drilling operation. In one or more embodiments, the operations system (120) may receive data from one or more sensors arranged to measure controllable parameters of the drilling operation. As a nonlimiting example, sensors may be arranged to measure WOB (weight on bit), RPM (rotations per minute of the drill string; i.e., rotational speed), GPM (flow rate of the mud pumps in gallons per minute), and ROP (rate of penetration of the drilling operation). The operations system (120) may further include a geosteering system. The geosteering system guides the direction of the drill bit (110). Generally, the goal of the geosteering system is to steer, horizontally and laterally, the drill bit (110) through the "pay zone" (i.e., the high production zone of a reservoir) in real time.

Figure 2:
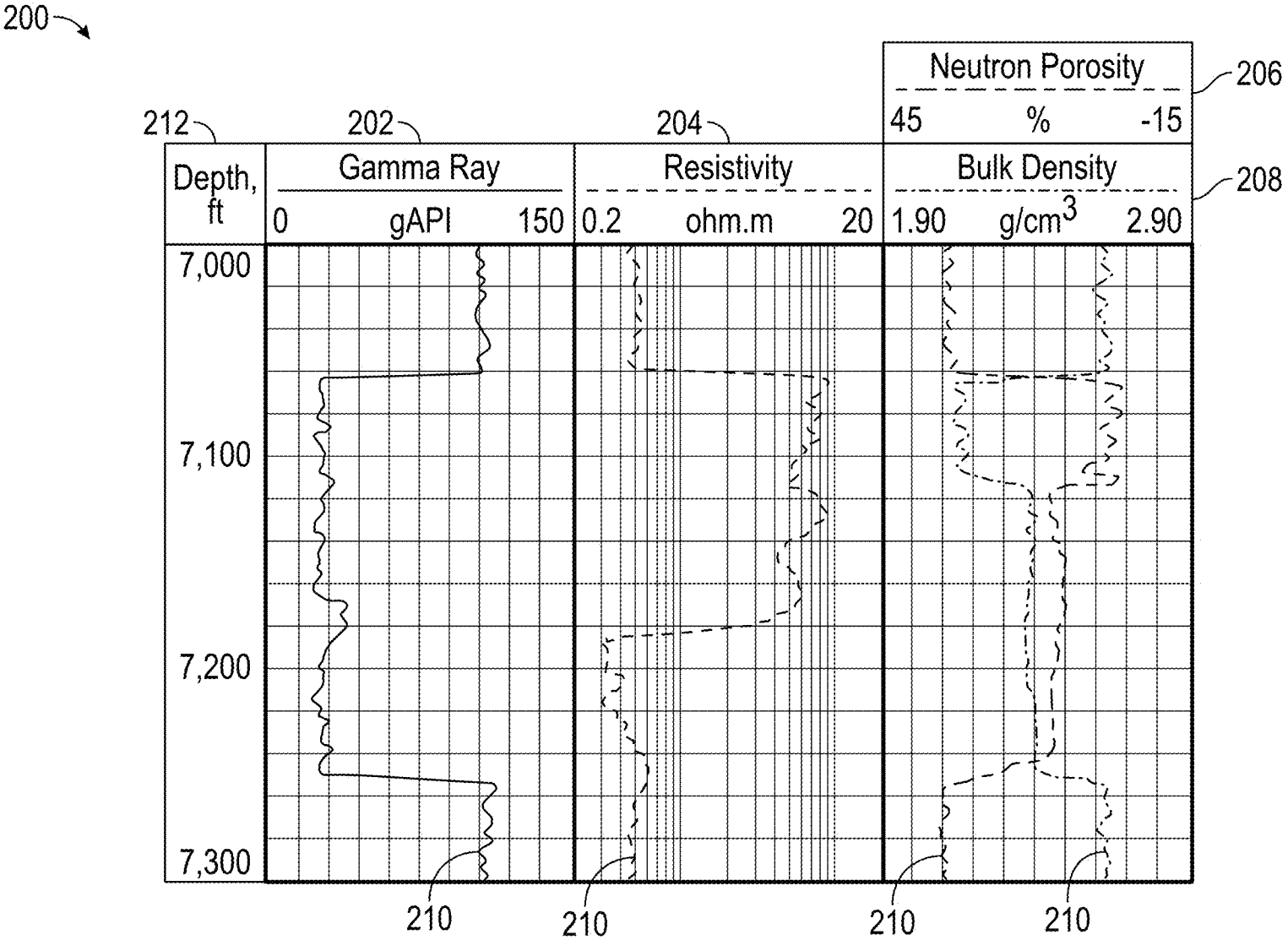
FIG. 2 depicts logs, such as logging while drilling (LWD) logs, in accordance with one or more embodiments.

FIG. 2 provides an example of conventional LWD logs (200). Some common logs, such as a gamma ray log (202), a resistivity log (204), neutron porosity log (206), and bulk density log (208) are shown, however, many more logs may be present during drilling operations as provided by LWD tools. Additional logs may include directional density logs and sonic logs, such as compressional and shear sonic logs. Each log is a record of log values (210) at an associated well depth (212). Here, it is noted that the term well depth (212), or more simply the depth of the wellbore (102), refers to the distance along the wellbore (102) and does not necessarily correspond with the orthogonal distance from the surface (104) where the orthogonal distance is measured along an axis oriented perpendicular to the surface (104), also known as the true vertical depth. The term "distance" is used herein equivalently to well depth (212) and refers to the distance traversed through the wellbore (102). By way of example, a portion of a wellbore (102) may be oriented horizontally, or parallel to the surface (104), such that its orthogonal distance remains fixed over the horizontal portion, however, the well depth (212) measures the distance along the wellbore (102) and is not stagnant over any horizontal portion of the wellbore (102). Additionally, the well depth (212) is continuous and strictly monotonically increasing as directed from the surface (104) to the most down-hole portion of the wellbore (102) even if the orthogonal distance, or true vertical depth, decreases.

In practice, while drilling a wellbore (102) the drill bit (110) does not progress through the subsurface formations (106) monotonically with time. That is, various surface or subsurface events may cause the drilling operation to be paused or for the drill bit (110) to be retracted. These events may include, but are not limited to: making drill string (108) connections; circulating drilling fluid (112); cleaning the wellbore (102); and removing and/or freeing drilling equipment stuck or lodged in the wellbore (102). For example, when using a top drive, drill string (108) connections are typically made every 90 feet. Further, when using a Kelly bushing and a rotary table, the drill string (108) must be retracted by 30 feet in order to add a single 30 foot section of drill pipe to the drill string (108). During the drilling operation, drilling fluid (112) may be circulated in order to control the density and/or rheology of the contents of the wellbore (102). During a period of drilling fluid (112) circulation, the drill bit (110) may be retracted by distances of hundreds of feet or more. Further, portions of the wellbore (102) may swell or otherwise constrict the wellbore (102) requiring that the drill bit (110) be retracted to make multiple cutting passes through those portions of the wellbore (102). One with ordinary skill in the art will appreciate that there are many events during a drilling operation that could trigger the need to pause, reverse, cycle, slow, or otherwise alter the progression of the drill bit (110) through one or more subsurface formations (106) during a drilling operation, such that not all possible events need be enumerated herein without posing a limitation on the instant disclosure.

To make the recorded-mode LWD logs, the recorded datasets from the various LWD tools are automatically processed, calibrated, and combined together using a time-depth merge algorithm. The result of these processes is one or more measured parameters each displayed in a column against a single, shared, increasing depth axis on a composite depth (measured depth) log. In other words, the time-depth merge algorithm, when applied to recorded-mode LWD logs, produces conventional LWD logs (200) as those shown in FIG. 2. In general, the time-depth merge algorithm advances well depth at a specified resolution (e.g., 0.5 ft increments) and retains the first instance with respect to time. This is because the first temporal instance of recorded data at a given depth is typically considered the most representative (i.e., accurate) of the local subsurface formation (106). This is a significant matter, because there may be a number of later time records recorded in the tool memory where the LWD tool(s) repeatedly passed the same well depth, due to the sometimes unpredictable nature of a drilling operation. These repeat measurements could be minutes or hours or even days later in time; and various properties of the formation could have changed since the initial measurement was made (temperature, drilling fluid invasion into the formation, displacement of reservoir gas or oil, invasion of fine particles, possibly reducing near-wellbore porosity or permeability, even the exact diameter of the open hole due to shale swelling, wellbore stress-induced deformation, etc.). Being able to take into account such borehole/formation changes could in some cases significantly influence the petrophysical interpretation (e.g., formation resistivity and porosity due to drilling fluid invasion, temperature's effect on neutron porosity). Additionally, embodiments disclosed herein, which make use of the repeat measurements, allow for signal-averaging over the repeat data to improve the precision of the processed data. However, it is emphasized that in the current practice using the time-depth merge algorithm, a large percentage of LWD tool data recorded in the downhole tool memories is never seen or used by petrophysicists. Discarding the majority of the recorded data represents a major missed opportunity; especially while considering the cost of acquiring a suite of LWD logs.

Further, using certain physical principles as guiding constraints along with artificial intelligence (AI) methods and algorithms, embodiments disclosed herein exploit the repeat-pass recorded tool data, to improve the precision of the well log data, refine the interpretation of certain targeted quantities (such as formation porosity, a measurement better measured with deep water based mud filtrate invasion to minimize effect of hydrocarbons), and extract formation dynamics, which can change and evolve rapidly in time, due to drilling-related perturbations of the near-wellbore formation, such as drilling fluid invasion.

Figure 3C:
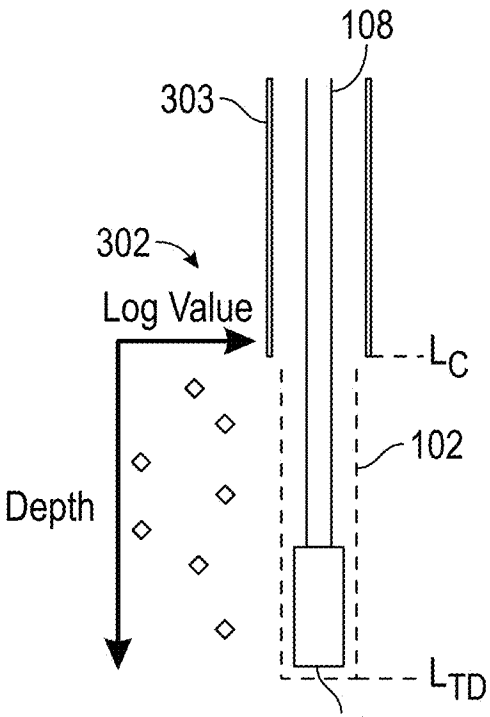
FIGS. 3A-3F depict a progression of a bottom hole assembly (BHA) while drilling and associated temporal well depth log, in accordance with one or more embodiments.
Figure 3B:
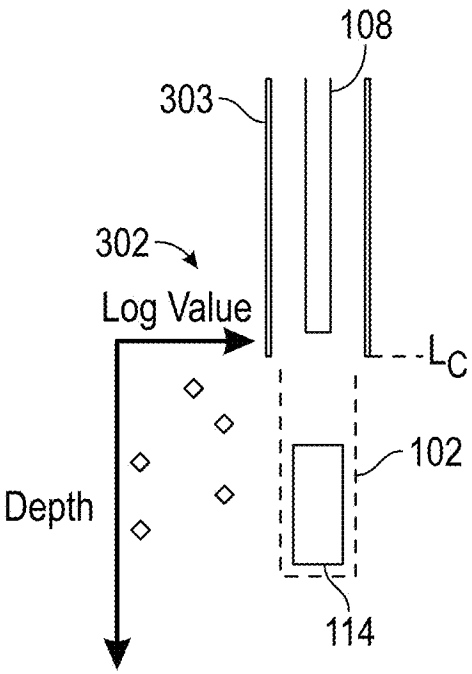
Figure 3A:
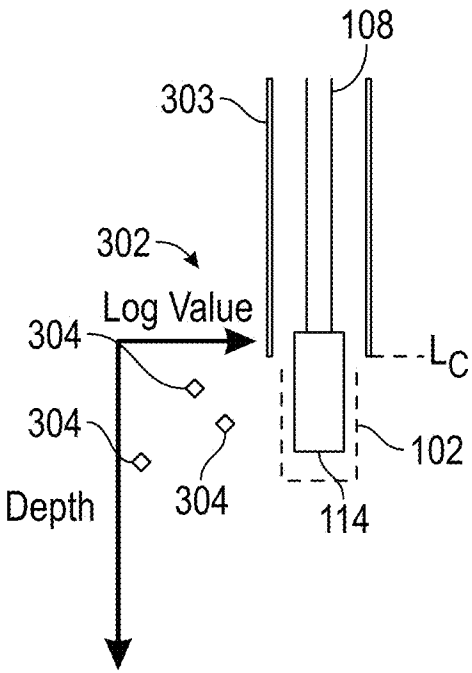

FIGS. 3A-3F depict the process of drilling a wellbore (102) and the acquisition of an example conventional LWD log (302). FIG. 3A depicts a drill string (108) and BHA (114) suspended into a wellbore (102). The wellbore is circumferentially enclosed near the surface by one or more casings (303). The casing(s) (303) extends a casing length, $L_C$, below the surface. FIGS. 3A-3C depict the progression of the BHA (114) while drilling to a target depth, where the length of the target depth from the surface is given by LTD. In FIG. 3B, the BHA (114) is at a depth greater than shown in FIG. 3A. Similarly, in FIG. 3C, the BHA (114) is at a depth greater than that shown in FIG. 3B. While drilling, an LWD tool measures a log value, and the measured log values (304) are shown according to depth as an example conventional LWD log (302). To avoid cluttering figures, the log values (304) are not annotated in FIGS. 3B-3F. As seen in FIGS. 3A-3C, measured log values (304) are acquired at increasing depths during drilling.

Figure 3D:
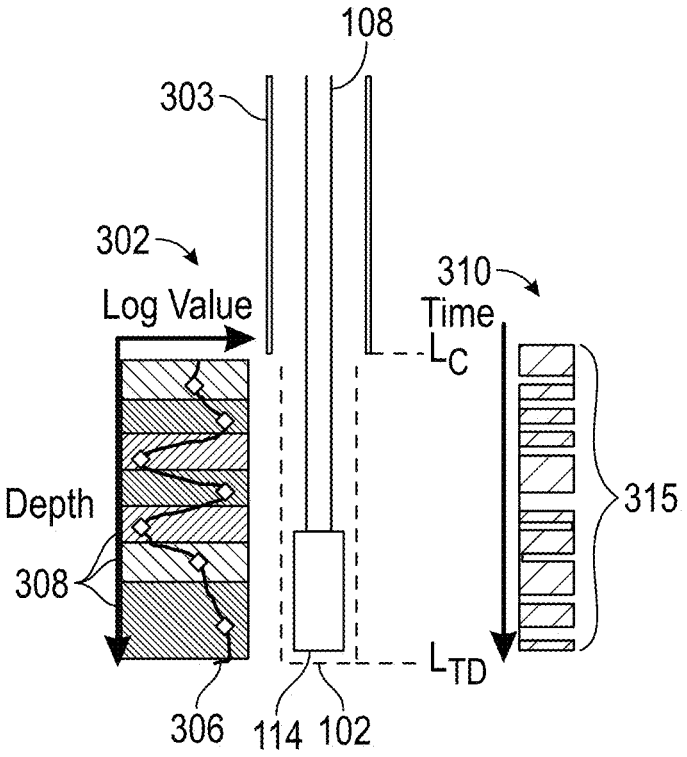

FIG. 3D depicts the BHA (114) upon reaching the target depth. As seen in FIG. 3D, an interpolation scheme may be applied to the measure log values (304) to form a continuous log value measurement (306). Further, the example conventional LWD log (302) may be evaluated and interpreted to identify and categorize various layers (308) of the subsurface. FIG. 3D also illustrates the LWD tool memory (310) in the time domain. In this representation, the "ticks" indicate periods of time (or slots in the memory) where a measured log value was recorded and any "gaps" represent areas that would be discarded (e.g., pauses in motion at drill string (108) connections). The portion of the LWD tool memory (310) containing the log values measured while drilling from the termination of the casing (303) to the target depth, as depicted in FIGS. 3A-3C, is labelled herein as the first portion (315).

Figure 3E:
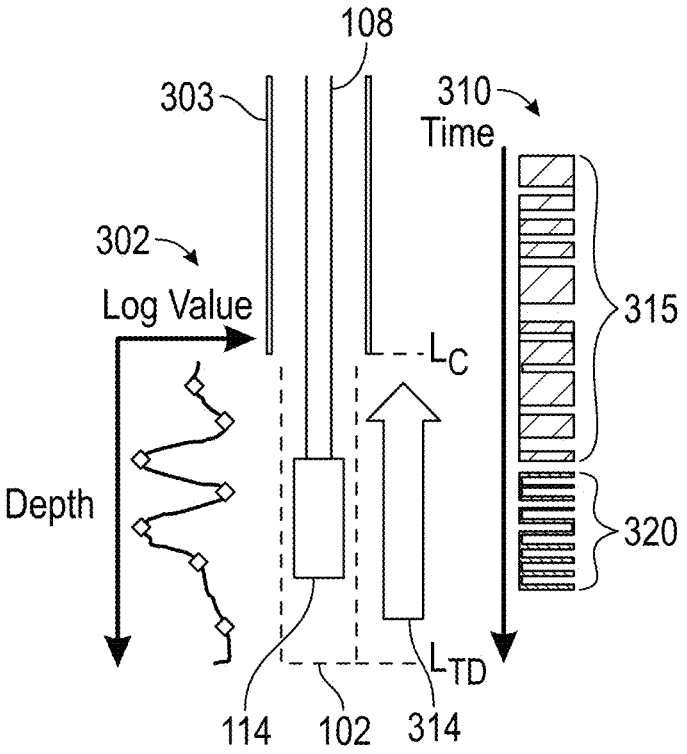

In many instances, the progression of the drill bit (110) through the subsurface (i.e., increasing well depths (212)) is not strictly monotonic with respect to operation time. In general, a drill bit (110) may be paused, cycled, and/or retracted many times during a drilling operation. FIG. 3E depicts the BHA (114) progressing upwardly (312) through the wellbore (102), for example, during a retraction event. Log values are measured during the upward progression and are recorded in the LWD tool memory (310). The log values obtained during the upward progression of the BHA (114) depicted in FIG. 3D are labelled herein as the second portion (320).

Figure 3F:
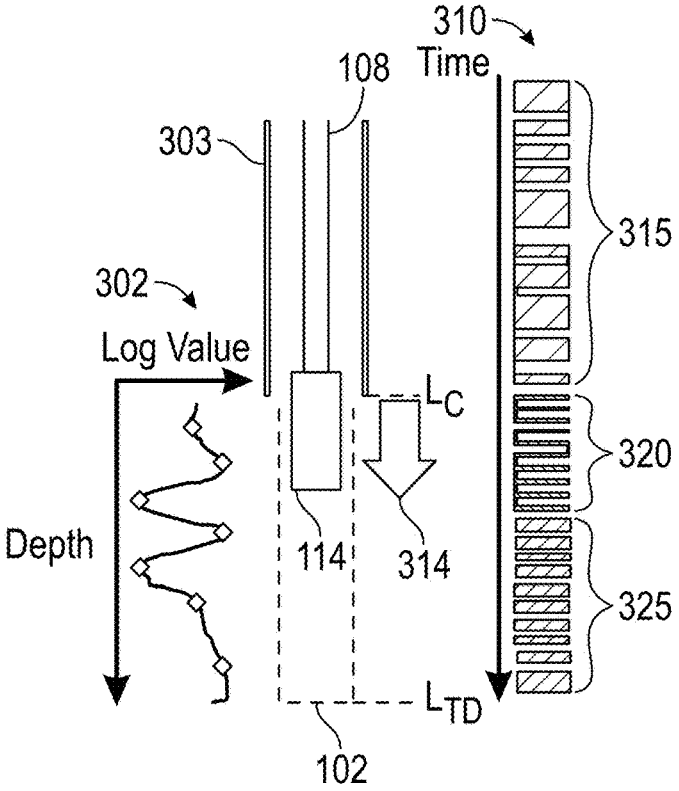

FIG. 3F depicts the BHA (114) in a downward progression (314) following the upward progression (312) or retraction event of FIG. 3E. Again, log values are measured during this interval and are recorded in the LWD tool memory (310). The log values obtained during the downward progression (314) of the BHA (114) depicted in FIG. 3F are labelled herein as the third portion (325).

FIGS. 3D-3F illustrate that the BHA (114) is often seen to pass by the same well depth more than one time. Because the BHA (114) may pass by a subsurface formation (106) at a given well depth more than one time, onboard LWD tools may record multiple values for one or more subsurface properties or measured quantities at the given well depth. A conventional LWD log, produced from the measured log values in the LWD tool memory (310) using the time-depth merge algorithm, would not use any data associated with the observed gaps (e.g., paused drilling) or the second portion (320) or the third portion (325) of the measured log values. Consequently, the conventional LWD logs constructed using the time-depth merge algorithm discard much of the recorded LWD data (i.e., LWD tool memory in the time domain).

Figure 4:
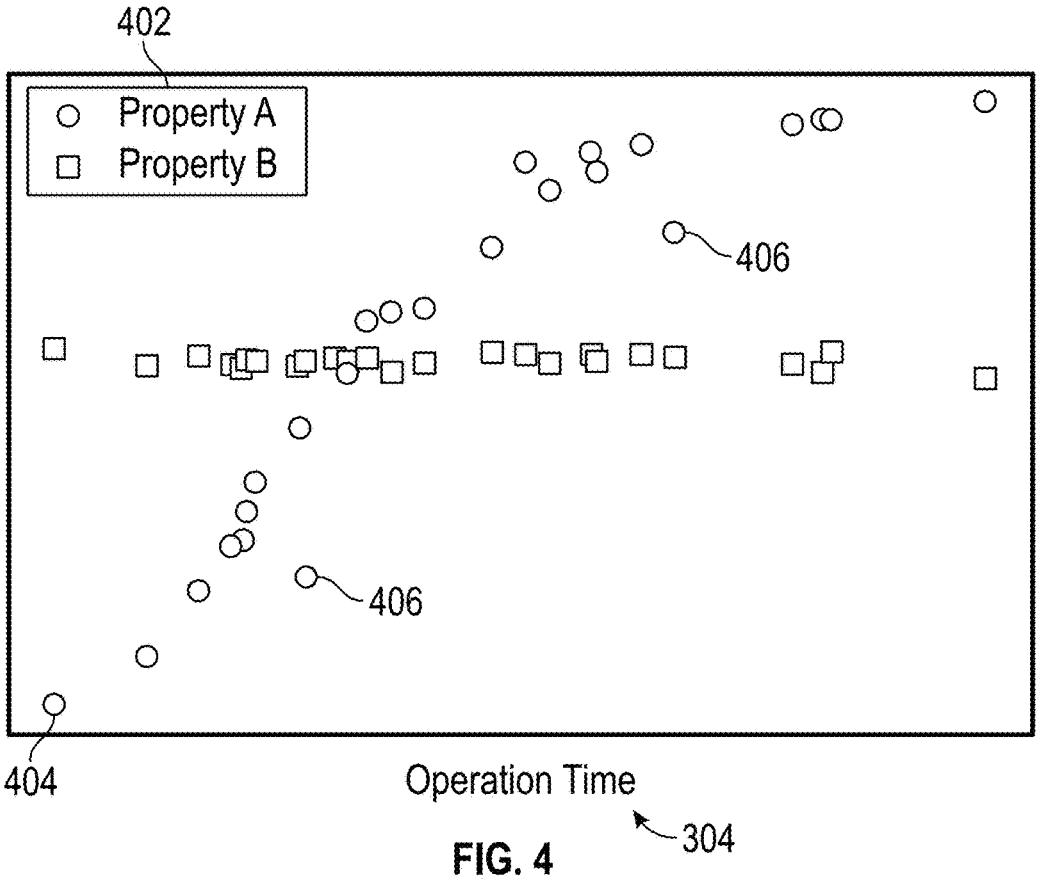
FIG. 4 depicts two arbitrary temporal property logs at a given well depth, in accordance with one or more embodiments.

FIG. 4 depicts the values for two arbitrary property measurements (402), labelled Property A and Property B, according to operation time (304) at a given depth. As seen in FIG. 4, Property A exhibits time-dependent behavior. Specifically, Property A has an initial, or first Property A value (404), and the measured value of Property A increases with operation time (304) until eventually saturating at a value. Time-dependent behavior, such as that exhibited by Property A may be attributed to a variety of drilling events and other time-dependent processes. For example, drilling fluid (112) invasion occurs behind the drill bit (110). That is, as the drill bit (110) cuts through a new portion of the subsurface, drilling fluid (112) enters to fill in the void and may permeate into the surrounding subsurface formation (106) affecting subsequent measurements. As another example, the speed at which the drill bit (110) and LWD tools pass a given well depth (212) may affect the measured value. In FIG. 4, two measurements annotated with the label 406, demonstrate relatively lower values than their temporal neighbors. Comparing the operation time (304) of these two measurements (406) with temporal log (i.e., LWD tool memory) may indicate, for example, that these measurements occurred during a rapid reentry of the drill bit (110) after a drill string connection event. Property B, as shown in FIG. 4, demonstrates some fluctuations in its measured value, however, Property B appears to be invariant to time and unaffected by drilling events. One with ordinary skill in the art will recognize that FIG. 4 is provided as an example and the depicted measured properties, Property A and Property B, are intentionally unnamed to promote generalization and depict time- and/or event-dependent behavior and time (and event) invariant behavior, respectively. However, to aid understanding, Property A could be envisioned as a moderate-depth resistivity affected by gradually increasing OBM invasion. In this case, it may be expected that its value over time would increase and then flatten out asymptotically. Further, an example of Property B may be a shallow-reading density porosity, which will essentially always be reading in a mud-invaded zone.

Figure 5A:
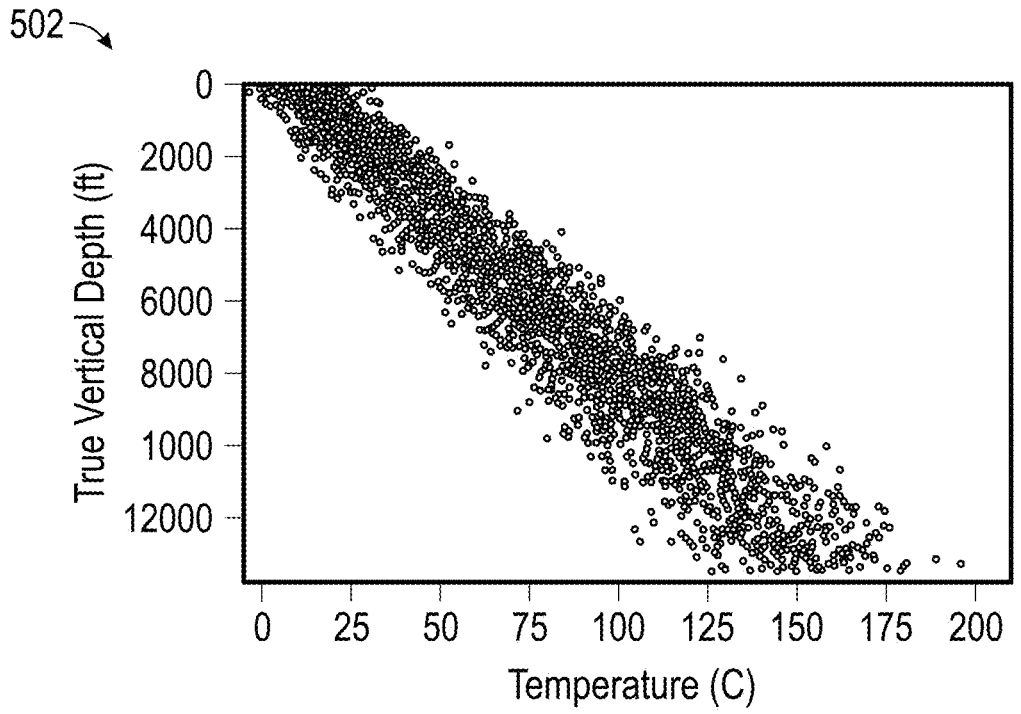
FIG. 5A depicts measured temperature values according to true vertical depth, in accordance with one or more embodiments.
Figure 5B:
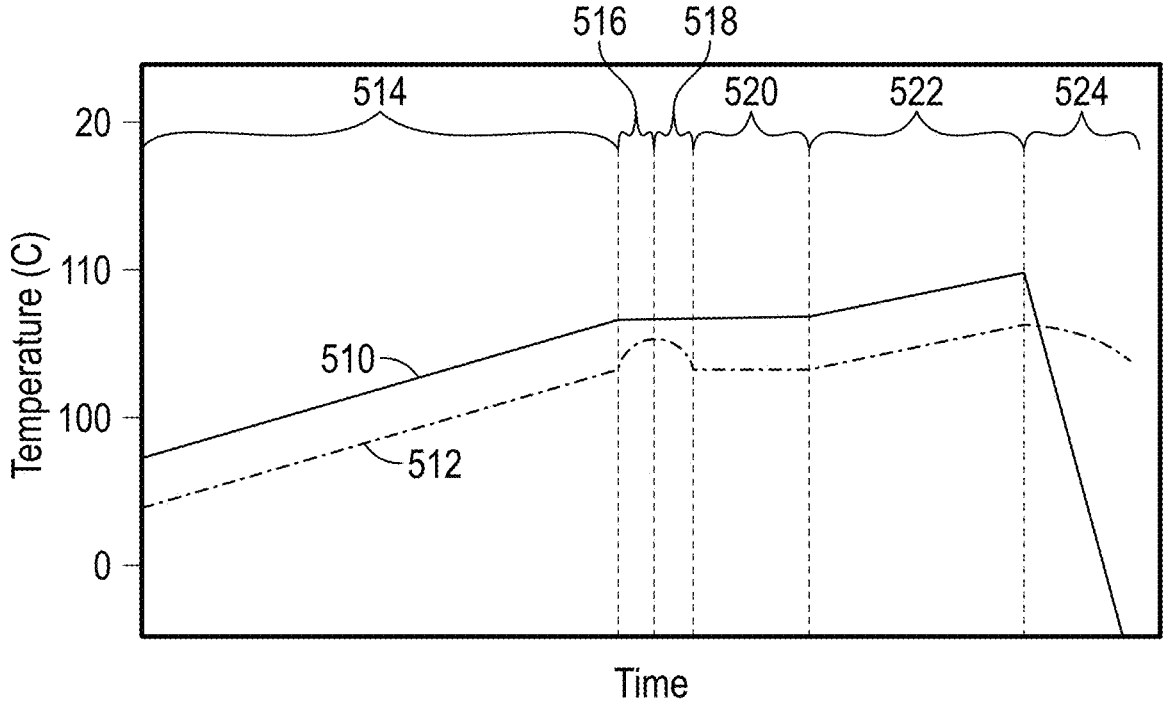
FIG. 5B depicts recorded temperature values at a given well depth according to time, in accordance with one or more embodiments.

In general, the measurements acquired by an LWD tool at a given well depth (212) may be temporally separated by minutes, hours, or even days. Over the elapsed time various properties of the subsurface formations (106) may change. As another example, FIGS. 5A and 5B depict temperature values recorded by a LWD tool according to well depth (212) and a subperiod of operation time, respectively, for a well. In FIG. 5A, the vertical axis is the true vertical depth and the horizontal axis indicates temperature. As seen in FIG. 5A, the temperature of the subsurface generally increases with true vertical depth, however, at any given true vertical depth, multiple temperature measurements exist and these measurements exhibit relatively large variance. As previously discussed, multiple temperature measurements exist at each depth because the LWD tool and drill bit (110) can make multiple passes over a given depth. For the present example, the variance in the temperature measurements may largely be explained by plotting the temperature measurements according to operation time.

FIG. 5B depicts the measured temperature values (512) and true formation temperature (510) over some period of time during the drilling operation. The temporal log of FIG. 5B, in view of operational state and parameters of the drilling rig (e.g., rate of penetration, mud flow rate, etc.), provide insight into the difference in measured and true formation temperature. The plot of FIG. 5B has been partitioned into six sections, namely, a first section (514), a second section (516), a third section (518), a fourth section (520), a fifth section (522), and a sixth section (524). During the first section (514), drilling is progressing steadily with a near constant rate of progression and steady mud flow. As the BHA (114) progresses deeper into the subsurface, the true formation temperature (510) increases, as does the measured temperature (512). However, as seen, during the first section (514), the measured temperature (512) is less than the true formation temperature (510). This is because the mud flow during drilling typically lowers the LWD tool temperature relative to the formation temperature, depending on the well depth, mud flow rate, etc. In the second section (516), drilling and mud flow are paused. Consequently, the measured temperature (512) steadily approaches the true formation temperature (510) as the LWD tool achieves temperature equilibrium with its surroundings. In the third section (518), drilling remains paused but mud flow resumes. As seen in the third section (518), the measured temperature (512) is reduced due to the influx of lower temperature mud cooling the LWD tool. In the fourth section (520), drilling remains paused and mud flows at a constant rate. In the fifth section (522), the mud continues to flow and drilling commences again at a steady rate. In the sixth section (524), the BHA (114) is tripping out of the wellbore (102). Thus, the true formation temperature (510) rapidly decreases but the measured temperature (512) lags behind due to the thermal mass of the LWD tool. It is noted that the use of conventional LWD logs, using the time-depth merge algorithm, would only use the measured temperatures (512) from the first section (514) and the fifth section (522). However, as illustrated by FIG. 5B, the measured temperature (512) may be corrected and enhanced (e.g., reduced signal-to-noise) by taking into account the operational parameters of the drilling rig (e.g., ROP, mud flow rate, etc.) and the temporal history of these operational parameters.

The examples of FIGS. 4, 5A, and 5B demonstrate that the recorded values of LWD tools may be affected by time-dependent changes in the surrounding environment and by various drilling events during the drilling operation. Further, as can be seen by these examples, there exists a strong correlation between drilling events, time elapsed, event history, and the value measured by an LWD tool. Changes to the subsurface formation may include, but are not limited to: drilling fluid invasion into the subsurface formation (106); displacement of reservoir gas or oil; invasion of fine particles (which may reduce near-wellbore porosity or permeability); wellbore (102) swelling or accumulation of mud cake; and wellbore (102) stress-induced deformation. Drilling events may include, but are not limited to: drill string (108) connections; drilling fluid (112) circulation; and fishing operations in the wellbore (102). One with ordinary skill in the art will appreciate that there are many mechanisms which may affect the measured values in one or more LWD logs. As such, descriptions of a select few mechanisms herein do not impose a limitation on the instant disclosure. As an example, and as depicted in FIG. 5B, the temperature measured by an LWD log may be closer to the true value if the drilling operation was paused for a long period of time before the measurement was acquired. This is because the BHA (114) may be considered a large thermal mass which needs to achieve thermal equilibrium with the surrounding subsurface before accurate temperature measurements may be acquired. In general, a property or other quantity measured by an LWD tool may be considered a function of the form $$MV = f(\text{well depth, drilling event, drill bit history, elapsed time}) + \epsilon, \quad \text{(EQ 1)}$$

where MV is the measured value and e represents random error. The drill bit history is a temporal record of prior drill string events and measured values. Currently, in the art, conventional LWD logs (200), like those shown in FIG. 2 do not take into account the effect of time, history, or drilling events on the measured quantities. Rather, in an attempt to circumvent these complexities, conventional LWD logs (200) are constructed using the time-depth merge algorithm, as previously described. As seen in the conventional LWD logs (200) of FIG. 2, only one value is shown at each well depth (212). However, by taking into account drilling events, the history of the drill bit, and other time-dependent phenomenon, the LWD logs may be improved to enhance the petrophysical interpretation (e.g., lithology identification) of the subsurface. Further, the change in properties over time at a given well depth (212) may be said to contain petrophysical information. As such, embodiments disclosed herein are related to methods for using all data collected from LWD tools, rather than just the first temporal values, to enhance LWD logs and promote high fidelity petrophysical interpretation of the subsurface formations (106).

In accordance with one or more embodiments, one or more machine-learning models is/are used to construct a temporal history of the drill string operation, correct property logs, and determine petrophysical properties of a subsurface based on observed changes in measured properties with time. Machine learning, broadly defined, is the extraction of patterns and insights from data. The phrases "artificial intelligence", "machine learning", "deep learning", and "pattern recognition" are often convoluted, interchanged, and used synonymously throughout the literature. This ambiguity arises because the field of "extracting patterns and insights from data" was developed simultaneously and disjointedly among a number of classical arts like mathematics, statistics, and computer science. For consistency, the term machine learning, or machine-learned, will be adopted herein, however, one skilled in the art will recognize that the concepts and methods detailed hereafter are not limited by this choice of nomenclature.

Machine-learning model types may include, but are not limited to, neural networks, random forests, generalized linear models, and Bayesian regression. Machine-learned model types are usually associated with additional "hyperparameters" which further describe the model. For example, hyperparameters providing further detail about a neural network may include, but are not limited to, the number of layers in the neural network, choice of activation functions, inclusion of batch normalization layers, and regularization strength. Commonly, in the literature, the selection of hyper-parameters surrounding a model is referred to as selecting the model "architecture".

Once a machine-learning model type and architecture have been selected, the machine-learned model is typically trained using a training set of data. The training data is composed of input and target pairs. Common training techniques, such as early stopping, adaptive or scheduled learning rates, and cross-validation may be used during training without departing from the scope of this disclosure.

Figure 6:
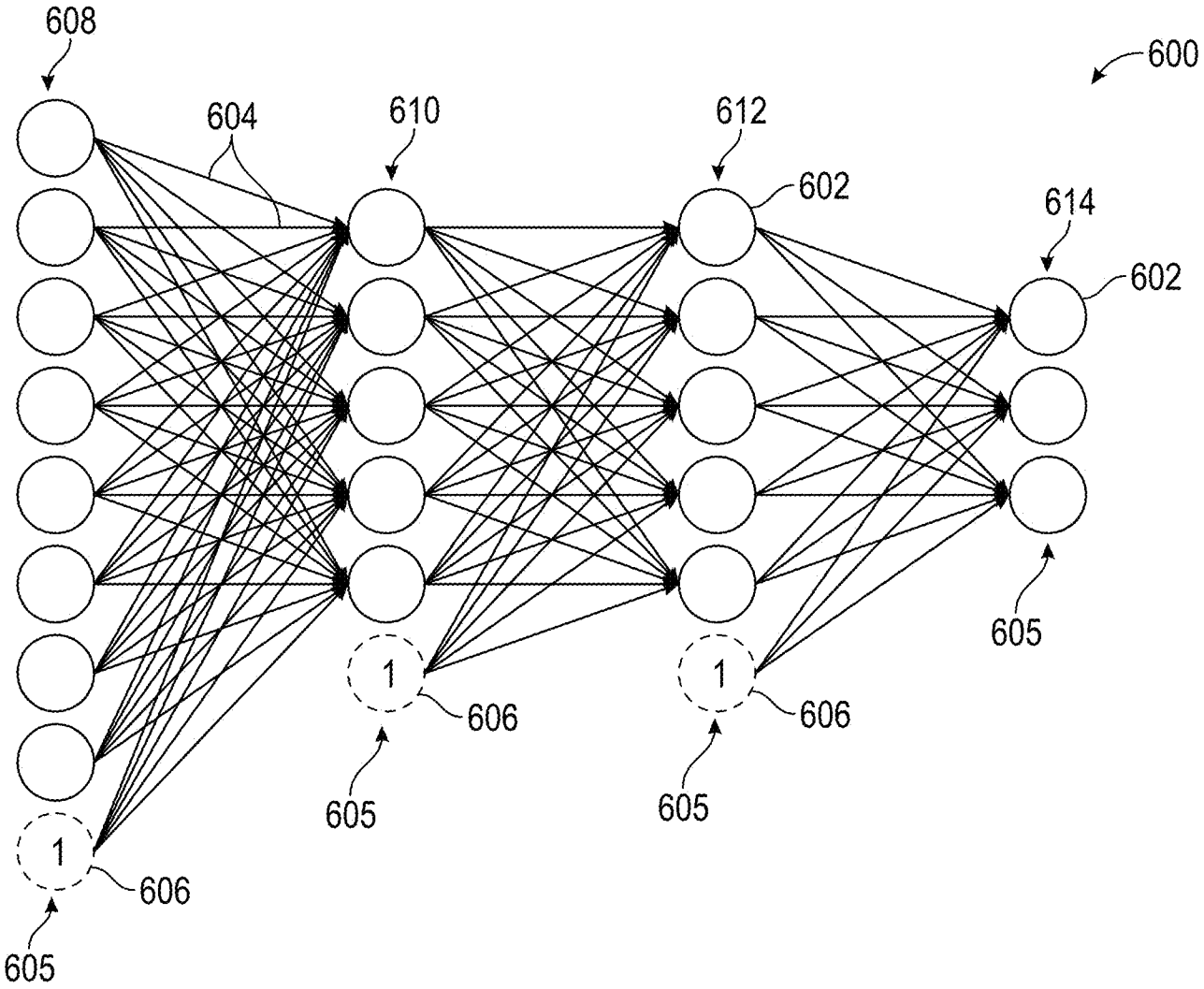
FIG. 6 depicts a neural network in accordance with one or more embodiments.

In some embodiments, the selected machine-learning model type is a neural network. A diagram of a neural network is shown in FIG. 6. At a high level, a neural network (600) may be graphically depicted as being composed of nodes (602), where here any circle represents a node, and edges (604), shown here as directed lines. The nodes (602) may be grouped to form layers (605). FIG. 6 displays four layers (608, 610, 612, 614) of nodes (602) where the nodes (602) are grouped into columns, however, the grouping need not be as shown in FIG. 6. The edges (604) connect the nodes (602). Edges (604) may connect, or not connect, to any node(s) (602) regardless of which layer (605) the node(s) (602) is in. That is, the nodes (602) may be sparsely and residually connected. A neural network (600) will have at least two layers (605), where the first layer (608) is considered the "input layer" and the last layer (614) is the "output layer". Any intermediate layer (610, 612) is usually described as a "hidden layer". A neural network (600) may have zero or more hidden layers (610, 612) and a neural network (600) with at least one hidden layer (610, 612) may be described as a "deep" neural network or as a "deep learning method". In general, a neural network (600) may have more than one node (602) in the output layer (614). In this case the neural network (600) may be referred to as a "multi-target" or "multi-output" network.

Nodes (602) and edges (604) carry additional associations. Namely, every edge is associated with a numerical value. The edge numerical values, or even the edges (604) themselves, are often referred to as "weights" or "parameters". While training a neural network (600), numerical values are assigned to each edge (604). Additionally, every node (602) is associated with a numerical variable and an activation function. Activation functions are not limited to any functional class, but traditionally follow the form $$A\sum_{i\in(incoming)}[(\text{node value})_i(\text{edge value})_i]\Big),$$

where i is an index that spans the set of "incoming" nodes (602) and edges (604) and f is a user-defined function. Incoming nodes (602) are those that, when viewed as a graph (as in FIG. 6), have directed arrows that point to the node (602) where the numerical value is being computed. Some functions for $f$ may include the linear function $f(x)=x$, sigmoid function $$f(x)=\frac{1}{1+e^{-x}},$$

and rectified linear unit function $f(x)=\max(0, x)$, however, many additional functions are commonly employed. Every node (602) in a neural network (600) may have a different associated activation function. Often, as a shorthand, activation functions are described by the function $f$ by which it is composed. That is, an activation function composed of a linear function $f$ may simply be referred to as a linear activation function without undue ambiguity.

When the neural network (600) receives an input, the input is propagated through the network according to the activation functions and incoming node (602) values and edge (604) values to compute a value for each node (602). That is, the numerical value for each node (602) may change for each received input. Occasionally, nodes (602) are assigned fixed numerical values, such as the value of 1, that are not affected by the input or altered according to edge (604) values and activation functions. Fixed nodes (602) are often referred to as "biases" or "bias nodes" (606), displayed in FIG. 6 with a dashed circle.

In some implementations, the neural network (600) may contain specialized layers (605), such as a normalization layer, or additional connection procedures, like concatenation. One skilled in the art will appreciate that these alterations do not exceed the scope of this disclosure.

As noted, the training procedure for the neural network (600) comprises assigning values to the edges (604). To begin training the edges (604) are assigned initial values. These values may be assigned randomly, assigned according to a prescribed distribution, assigned manually, or by some other assignment mechanism. Once edge (604) values have been initialized, the neural network (600) may act as a function, such that it may receive inputs and produce an output. As such, at least one input is propagated through the neural network (600) to produce an output. Recall, that a given training data set will be composed of inputs and associated target(s), where the target(s) represent the "ground truth", or the otherwise desired output. The neural network (600) output is compared to the associated input data target(s). The comparison of the neural network (600) output to the target(s) is typically performed by a so-called "loss function"; although other names for this comparison function such as "error function" and "cost function" are commonly employed. Many types of loss functions are available, such as the mean-squared-error function, however, the general characteristic of a loss function is that the loss function provides a numerical evaluation of the similarity between the neural network (600) output and the associated target(s). The loss function may also be constructed to impose additional constraints on the values assumed by the edges (604), for example, by adding a penalty term, which may be physics-based, or a regularization term. Generally, the goal of a training procedure is to alter the edge (604) values to promote similarity between the neural network (600) output and associated target(s) over the data set. Thus, the loss function is used to guide changes made to the edge (604) values, typically through a process called "backpropagation".

While a full review of the backpropagation process exceeds the scope of this disclosure, a brief summary is provided. Backpropagation consists of computing the gradient of the loss function over the edge (604) values. The gradient indicates the direction of change in the edge (604) values that results in the greatest change to the loss function. Because the gradient is local to the current edge (604) values, the edge (604) values are typically updated by a "step" in the direction indicated by the gradient. The step size is often referred to as the "learning rate", similar to but not to be confused with, the learning rate of gradient boosted trees, and need not remain fixed during the training process. Additionally, the step size and direction may be informed by previously seen edge (604) values or previously computed gradients. Such methods for determining the step direction are usually referred to as "momentum" based methods.

Once the edge (604) values have been updated, or altered from their initial values, through a backpropagation step, the neural network (600) will likely produce different outputs. Thus, the procedure of propagating at least one input through the neural network (600), comparing the neural network (600) output with the associated target(s) with a loss function, computing the gradient of the loss function with respect to the edge (604) values, and updating the edge (604) values with a step guided by the gradient, is repeated until a termination criterion is reached. Common termination criteria are: reaching a fixed number of edge (604) updates, otherwise known as an iteration counter; a diminishing learning rate; noting no appreciable change in the loss function between iterations; reaching a specified performance metric as evaluated on the data or a separate hold-out data set. Once the termination criterion is satisfied, and the edge (604) values are no longer intended to be altered, the neural network (600) is said to be "trained".

Figure 7A:
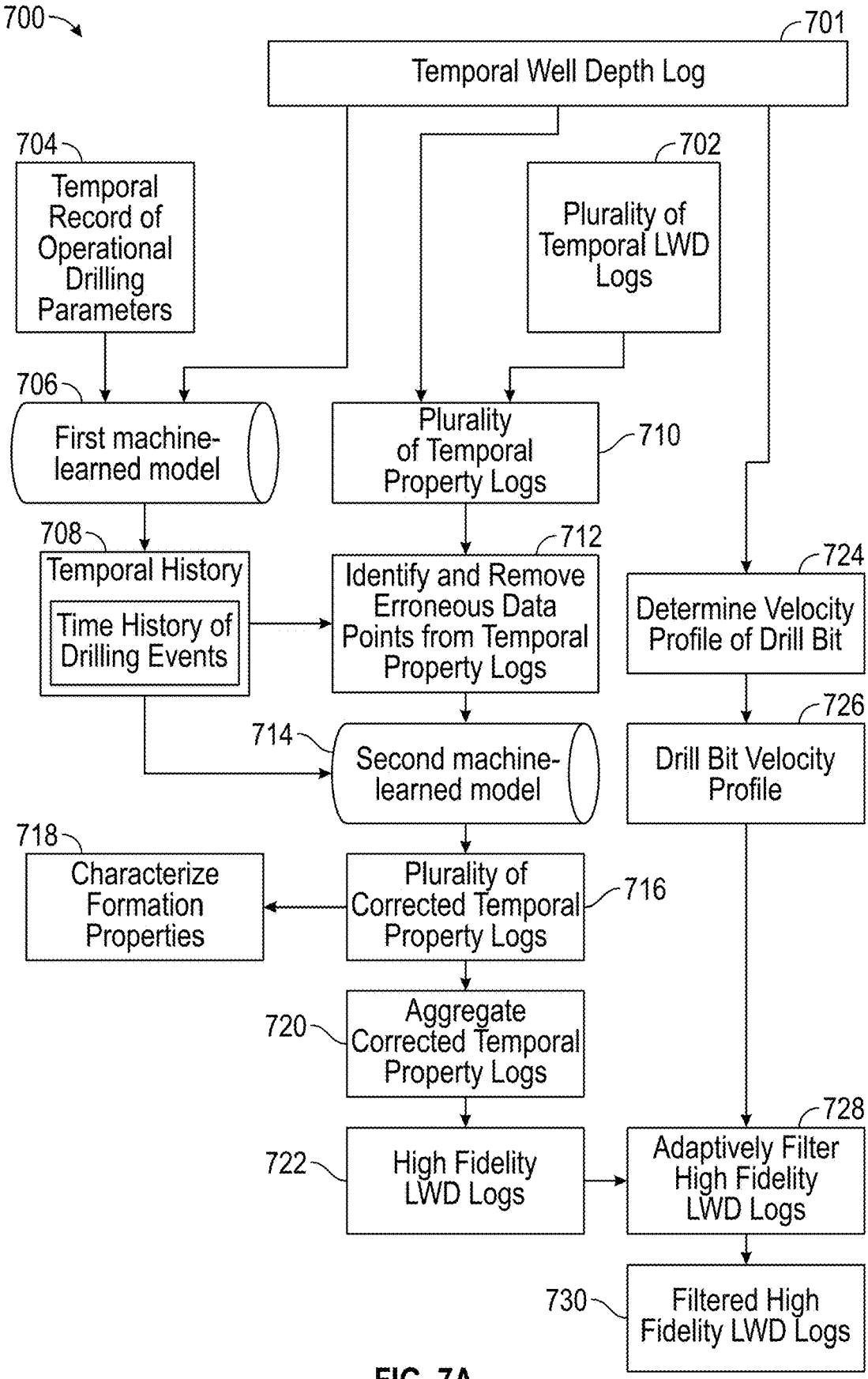
FIG. 7A depicts a process in accordance with one or more embodiments.

In accordance with one or more embodiments, FIG. 7A depicts a process (700) of using two machine-learning models to construct a temporal history of the drilling operation and to correct temporal property logs. While drilling a well, or upon completion of drilling a well, a temporal well depth log (701) is obtained. The temporal well depth log (701) records the location of the drill bit (110) in terms of well depth (212) with respect to operation time (i.e., time elapsed since the initiation of drilling activities). Additionally, a plurality of temporal LWD logs (702) is obtained. A temporal LWD log contains the measured values from an LWD tool with respect to operation time (e.g., the LWD tool memory (310)). For example, an LWD tool may be configured to measure temperature. In this case, the LWD log would be a series of temperature values, each associated with a recorded time. Further, a temporal record of operational drilling parameters (704) is obtained. The temporal record of operational drilling parameters (704) indicates the state or value of a drilling parameter for each time during the drilling operation. Operational drilling parameters may include rate of penetration (ROP), weight on bit (WOB), drilling fluid (112) density and/or rheology, and drilling fluid (112) flow rate. Other operational drilling parameters not listed may be used without departing from the scope of this disclosure. In some embodiments, the operational drilling parameters are recorded by and obtained from the operations system (120) of the well site (100).

The temporal well depth log (701) and the temporal record of operational drilling parameters (704) are processed by a first machine-learning model (706). The first machine-learning model (706) assigns a drilling event to each time during the drilling operation. In other words, the first machine-learning model outputs a temporal history (708), where the temporal history includes a collection of ordered drilling events.

The temporal well depth log (701) may be evaluated with the plurality of temporal LWD logs (702) to create a plurality of temporal property logs (710). A temporal property log indicates the values of a property of measured quantity, as sensed by an LWD tool, with respect to time (e.g., FIG. 4). A temporal property log may be constructed for each measured property or quantity at every well depth (212) in the wellbore (102). With the temporal history (708), as determined by the first machine-learning model (706), in hand, spurious or outlier values may be identified and removed from the temporal property logs (710). For example, the temporal history (708) may indicate that a drilling fluid (112) circulation event occurred while a temperature value was recorded. Because a high influx of drilling fluid (112) is known to affect the measured temperature, in one or more embodiments, this temperature value may be flagged for removal. In Block 712, using the temporal history (708), erroneous data points are identified and removed from the plurality of temporal property logs (710).

In accordance with one or more embodiments, the plurality of temporal property logs (710), after erroneous data points have been identified and removed, is processed by a second machine-learned model (714). The second machine-learning model (714) accepts a temporal property log along with the temporal history (708) and outputs a corrected temporal property log. The second machine-learning model (714) effectively acts as a surrogate for EQ. 1, where the second machine-learning model (714) is capable of predicting a measured value of a temporal log while accounting for the time elapsed and history of drilling events. In accordance with one or more embodiments, the second machine-learned model (714) is trained using a loss function that is regularized or constrained with physical information. For example, the loss function may require that the predicted value of temperature increase monotonically with well depth (212) after accounting for drilling events. In accordance with one or more embodiments, the second machine-learned model determines a corrected formation temperature for each true vertical depth (502) taking into account the temporal history of the drill bit (110), elapsed time, and current drilling event. The corrected formation temperature is then used to correct the measured values of other properties (e.g., density, porosity, etc.). When applied to each temporal property log, the second machine-learning model produces a plurality of corrected temporal property logs (716). In one or more embodiments, a single machine-learning model is constructed to perform the functions of the first and second machine-learning models such that only one machine-learned model is required.

In accordance with one or more embodiments, the plurality of corrected temporal property logs (716) is analyzed to characterize properties of the subsurface formations (106) as shown in Block 718. For example, changes in measured values with respect to time, after correction of drilling events, is used to provide enhanced petrophysical interpretation of the subsurface. In accordance with one or more embodiments, the plurality of corrected temporal property logs (716) is used to construct a hydrocarbon quick-look log. The hydrocarbon quick-look log depicts differences in measured properties and/or parameters of the subsurface formations (106) temporally to highlight the sweeping away of hydrocarbons by drilling fluid (112) invasion. In accordance with one or more embodiments, the hydrocarbon quick-look log is used to calibrate a change in shallow resistivity and/or shallow nuclear magnetic resonance (NMR).

In accordance with one or more embodiments, the plurality of corrected temporal property logs (716) is used to improve true formation resistivity ($R_t$) inversion. This is done by comparing successive passes (repeat data points) at each given depth with invasion under a monotonicity constraint. For example, accounting for drilling events, a level of invasion should increase monotonically with time, typically levelling off with drilling fluid (112) saturation. Thus, in one or more embodiments, any of the one more machine-learning models may include, and/or be trained with, a physics-based or physics-informed penalty or regularization term. For example, in one or more embodiments, any of the one or more machine-learning models may include a penalty term enforcing a monotonicity constraint on a measured property with respect to well depth.

In accordance with one or more embodiments, the measured values of the corrected property logs (716) are shifted to account for time-dependent factors and drilling events. Once shifted, the measured values in each log in a the plurality of corrected temporal property logs (716) are aggregated, as depicted in Block 720. For example, in one or more embodiments, the aggregation may involve an average where the measured values in a corrected temporal property log are combined into one mean value. Because a corrected temporal property log (716) exists for each well depth (212), the aggregated values may be collected to form an LWD log similar to the conventional LWD logs of FIG. 2, but with higher fidelity because the entirety of the LWD log, and not just the first measured value, is being used. That is, upon aggregation, high fidelity LWD logs (722) are formed.

Returning once more to the temporal depth log (701), the temporal depth log (701) may be analyzed to determine a velocity profile of the drill bit (724). As previously stated, the temporal depth log (701) consists of the location of the drill bit (110) in terms of well depth (212) with respect to operation time. As such, the derivative of the temporal depth log (701) with respect to time yields the velocity of the drill bit (110) at each time during drilling (the drill bit velocity profile (726)). One with ordinary skill in the art will recognize that many methods may be employed to determine the derivative of the temporal well depth log (701). For example, a forward or centered finite difference method may be applied to the temporal well depth log (701) to determine the velocity profile of the drill bit (724). Typically, conventional LWD logs (200) are filtered. For example, a moving average or convolution filter may be employed to smooth a conventional LWD log. These filters are considered "windowed" filters as they act on a specified number of adjacent data points forming a window. As shown in Block 728, in one or more embodiments, an adaptive filter is applied to the high fidelity LWD logs (722). The adaptive filter is a windowed filter, however, the window size (or the number of adjacent data points considered) is not fixed. Rather, the window size is locally dependent on the drill bit velocity profile (726). The result of the adaptive filter applied to the high fidelity LWD logs (722) is a plurality of filtered high fidelity LWD logs (730). In some embodiments, the adaptive filter may be adjusted to increase the spatial resolution (well depth (212) resolution) of the resulting filtered high fidelity LWD logs (730).

Figure 7B:
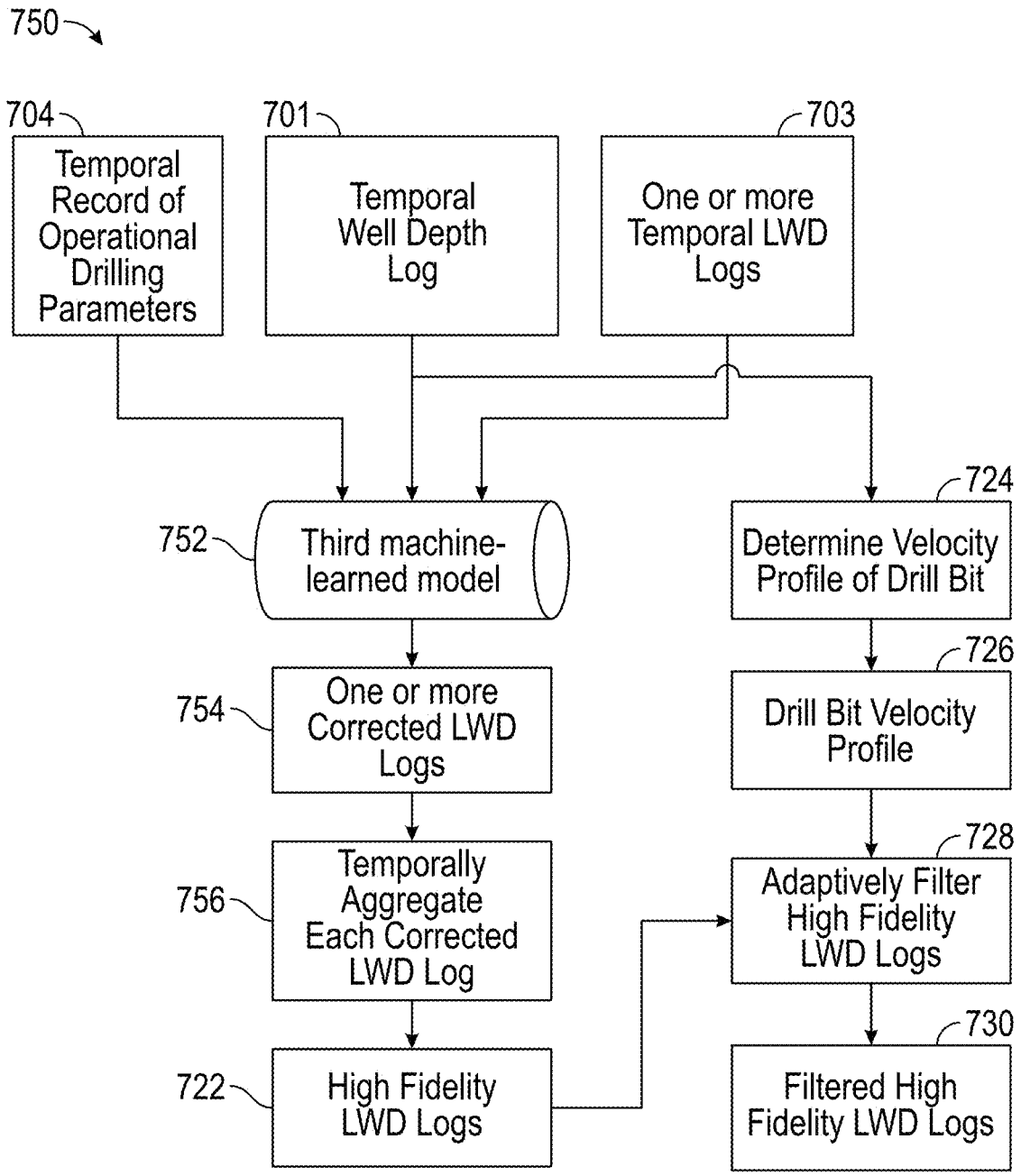
FIG. 7B depicts a process in accordance with one or more embodiments.

In accordance with one or more embodiments, FIG. 7B depicts a process (750) of using a single machine-learning model to determine high fidelity LWD logs. While drilling a well, or upon completion of drilling a well, a temporal well depth log (701) is obtained. The temporal well depth log (701) records the location of the drill bit (110) in terms of well depth (212) with respect to operation time (i.e., time elapsed since the initiation of drilling activities). Additionally, one or more temporal LWD logs (703) are obtained, where each temporal LWD log contains a measured property value from a given LWD tool with respect to operation time (e.g., the LWD tool memory (310)). For example, an LWD tool may be configured to measure temperature. In this case, the LWD log would be a series of temperature values, each associated with a recorded time. Further, a temporal record of operational drilling parameters (704) is obtained. The temporal record of operational drilling parameters (704) indicates the state or value of a drilling parameter for each time during the drilling operation. Operational drilling parameters may include rate of penetration (ROP), weight on bit (WOB), drilling fluid (112) density and/or rheology, and drilling fluid (112) flow rate. Other operational drilling parameters not listed may be used without departing from the scope of this disclosure. In some embodiments, the operational drilling parameters are recorded by and obtained from the operations system (120) of the well site (100).

The temporal well depth log (701), the temporal record of operational drilling parameters (704), and the one or more temporal LWD logs (703) are processed by a machine-learning model, depicted in FIG. 7B as a third machine-learning model (752). The third machine-learning model (752) outputs corrected values (754) for each of the one or more temporal LWD logs (703) taking into account the temporal record of operational drilling parameters (704) and the temporal well depth log (701). In one or more embodiments, the third machine-learning model (752) effectively acts as a surrogate for EQ. 1, where the third machine-learning model (752) is capable of predicting a measured value of an LWD log while accounting for the time elapsed and history of drilling events. In accordance with one or more embodiments, the third machine-learning model (752) is trained using a loss function that is regularized or constrained with physical information. For example, the loss function may require that the predicted value of temperature increase monotonically with well depth (212) after accounting for drilling events.

In one or more embodiments, each of the one or more corrected LWD logs (754) may be temporally aggregated, as depicted in Block 756. For example, in one or more embodiments, the aggregation may involve an average where the measured values in a corrected LWD log are combined into one mean value. In one or more embodiments, the aggregated values may be collected to form an LWD log similar to the conventional LWD logs of FIG. 2, but with higher fidelity because the entirety of the LWD log, and not just the first measured value, is being used. That is, upon aggregation, high fidelity LWD logs (722) are formed.

Returning once more to the temporal depth log (701), the temporal depth log (701) may be analyzed to determine a velocity profile of the drill bit (724). As previously stated, the temporal depth log (701) consists of the location of the drill bit (110) in terms of well depth (212) with respect to operation time. As such, the derivative of the temporal depth log (701) with respect to time yields the velocity of the drill bit (110) at each time during drilling (the drill bit velocity profile (726)). One with ordinary skill in the art will recognize that many methods may be employed to determine the derivative of the temporal well depth log (701). For example, a forward or centered finite difference method may be applied to the temporal well depth log (701) to determine the velocity profile of the drill bit (724). Typically, conventional LWD logs (200) are filtered. For example, a moving average or convolution filter may be employed to smooth a conventional LWD log. These filters are considered "windowed" filters as they act on a specified number of adjacent data points forming a window. As shown in Block 728, in one or more embodiments, an adaptive filter is applied to the high fidelity LWD logs (722). The adaptive filter is a windowed filter, however, the window size (or the number of adjacent data points considered) is not fixed. Rather, the window size is locally dependent on the drill bit velocity profile (726). The result of the adaptive filter applied to the high fidelity LWD logs (722) is filtered high fidelity LWD logs (730). In some embodiments, the adaptive filter may be adjusted to increase the spatial resolution (well depth (212) resolution) of the resulting filtered high fidelity LWD logs (730).

In accordance with one or more embodiments, one or more of the machine-learning models may be trained to recognize various formation property changes with time. For example, one or more machine-learning models may be configured to detect approaching adjacent formations to aid in geosteering. In one or more embodiments, a machine-learning model is configured to compare shallow, medium, and deep resistivity sensors to sense whether drilling is occurring in a homogeneous formation, or approaching an adjacent formation which have drastic characteristics in terms of resistivity, such as a tight formation with high resistivity or water zone with low resistivity, so that complex horizontal wells can be placed in targeted reservoirs. In one or more embodiments, a machine-learning model is configured to detect fine-particle invasion. For example, by comparing the shallowest density measurements on different passes and how these measurements evolve with time, the second machine-learning model can detect fine-particle invasion through a drop in the computed porosity. Further, shallow NMR measurements can also show decreased relaxation times as a result of fine-particle invasion. Additionally, drilling fluid invasion that may have been detected through similar means, although it should be a higher-order perturbation to these quantities. In accordance with one or more embodiments, a machine-learning model is configured to determine drilling-induced formation fracturing. For example, a decrease in drilling fluid returns can be used as a gross indicator of formation fracturing. Finer fracturing can be indicated by an increase in porosity from shallow density measurements, changes in shallow NMR relaxation times (increasing), as well as changes in resistivity measurements (for example, increasing the induction resistivity due to oil-base mud invading into radial fractures).

In accordance with one or more embodiments, a machine-learning model may be configured to determine borehole diameter and/or shape changes. Borehole constriction can in an extreme case show up as an increase in surface torque. It can also show up as a shift in borehole fluid corrections for density or resistivity readings. "Egging" or ellipsoidal deformation of a borehole due to geological stress may show up in azimuthally-binned tool measurements, such as ultrasonic caliper (different diameter readings at different angles), azimuthal density (different stand-offs at different angles), azimuthal resistivity (shift in image coloration due to inaccurately-applied borehole fluid corrections at certain angles). In one or more embodiments, a machine-learning model may be configured to determine all of the identified quantities of the previously described embodiments. In practice, a machine-learning model configured to determine multiple quantities may take advantage of a principle known in the literature as joint learning, where the machine-learning model may exploit correlations between targets. In one or more embodiments, the second machine-learning model estimates the temperature of the downhole drilling fluid (112) at each depth and for each pass (time), taking into account the speed and pre-history of the logging tool and in particular, the cooling effect from the injection of drilling fluid (112). The estimated downhole drilling fluid (112) temperature is used to correct the measured resistivities and other downhole LWD measurements that exhibit a temperature dependence. Again, as previously stated, in one or more embodiments, a single machine-learning model is constructed to perform the functions of the first machine-learning model (drilling event identification) and second machine-learning models such that only one machine-learning model is required.

Figure 8:
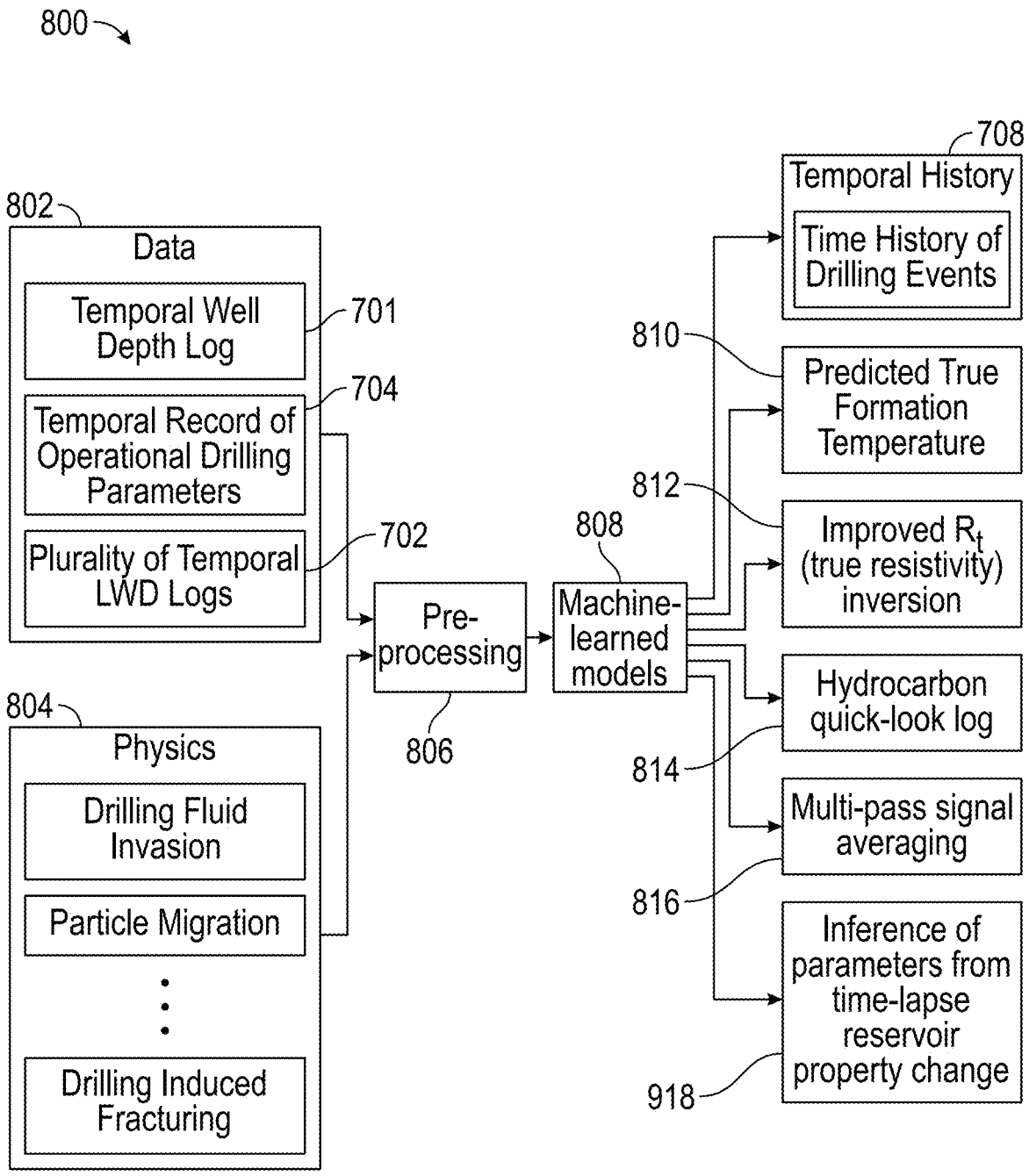
FIG. 8 depicts a workflow in accordance with one or more embodiments.

In accordance with one or more embodiments, FIG. 8 illustrates an AI-based workflow (800). Data (802) is collected from one more LWD tools and sensors with monitor a drilling operation. The data (802) includes, at least, a temporal well depth log (701), a temporal record of operational drilling parameters (704), and a plurality of temporal LWD logs (702). Further, information regarding the physics (804) of a drilling operation and a description of the physical changes that may occur to a wellbore (102) over time are considered. Physics (804) information may include, but is not limited to, drilling fluid (112) invasion, particle migration, and drilling induced fracturing. The data (802) and physics (804) information are preprocessed. Preprocessing (806) may include organizing the data (802) according to well depth and time. Preprocessing (806) may further include imposing a physics-based constraint (such as a temporal or spatial (i.e., depth) monotonicity constraint) on the data (802). Once preprocessed, the data (802) is processed, along with any associated physics (804) information, by one or more machine-learning models (808). The one or more machine-learning models (808) may be of any type and architecture known in the art. The one or more machine-learning models, upon processing the data (802) along with any known physics (804), produces a variety of useful outputs. The outputs may include a temporal history (708), which as previously described, consists of a temporal sequence of identified drilling events. Further, the one or more machine-learning models (808) may output a prediction for the true formation temperature (810) at each true vertical depth (502) in a wellbore (102). In one or more embodiments, the output of the one or more machine-learned models is used to produce a hydrocarbon quick-look log (814) which depicts the sweeping away of hydrocarbons corresponding to an influx of drilling fluid (112).

In one or more embodiments, the one or more machine-learning models (808) provides corrected LWD logs such that the measured values of the LWD logs may be averaged to create high-fidelity LWD logs. In other words, measured values (i.e., LWD tool measurements or signals) recorded during repeat passes of the drill bit (110) may be average temporally resulting in a multi-pass averaged signal for each well depth. Additionally, the one or more machine-learning models (808) provides an improved estimate of true resistivity, $R_t$ (812). In one or more embodiments, the machine-learning models (808) predict the temperature of the drilling fluid (112) at each depth and for each pass (820), taking into account the speed and pre-history of the drill bit (110) and in particular, the cooling effect from the pumping of drill fluid (112) into the wellbore (102). Knowledge of the downhole drilling fluid (112) temperature is used to correct the measured resistivities and other downhole LWD measurements that exhibit a temperature dependence.

Finally, in accordance with one or more embodiments, the one or more machine-learned models (808) evaluates the temporal differences (818) in LWD logs at one or more well depths in order to determine a parameter of the subsurface formation (106) and/or reservoir. In other words, the time rate of change, and the magnitude of change in one or more quantities measured by LWD tools is/are used to determine properties of the reservoir. Determination of subsurface formation (106) and/or reservoir properties may aid in the geosteering of the drill bit (110) during a drilling operation.

Figure 9A:
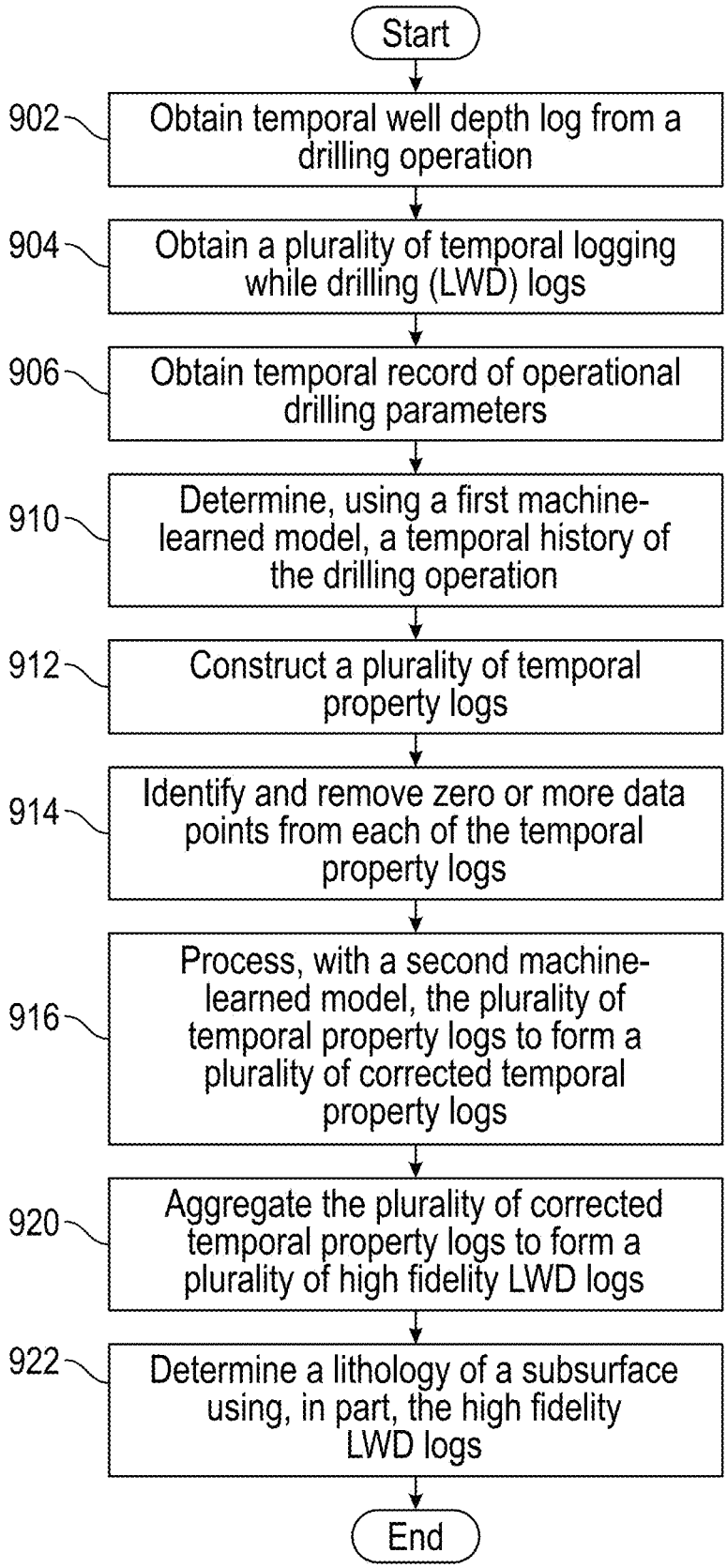
FIG. 9A depicts a flowchart in accordance with one or more embodiments.

In accordance with one or more embodiments, FIG. 9A depicts a flowchart generally outlining the process of constructing high fidelity LWD logs (730) and using these logs for enhanced petrophysical interpretation of the subsurface near the wellbore (102). In Block 902, a temporal well depth log (701) is obtained from a drilling operation. The temporal well depth log (701) indicates the time history of the well depth (212) of the drill bit (110) while drilling during the drilling operation. Additionally, as shown in Blocks 904 and 906, a plurality of temporal logging while drilling (LWD) logs (702) and a temporal record of operational drilling parameters (704) are obtained, respectively, for the drilling operation. The plurality of temporal LWD logs (702) indicate the measured values of one or more LWD tools throughout the period of drilling. Likewise, the temporal record of operational drilling parameters (704) indicates the values of one or more drilling parameters throughout the drilling operation.

In Block 910, using a first machine-learning model (706), a temporal history (708) of the drilling operation is determined. The temporal history (708) is composed of, at least, and ordered time history of drilling events. The drilling events in the temporal history (708) are identified by the first machine-learning model (706) and may include events such as drilling fluid (112) circulation and drill string (108) connections. As depicted in Block 912, a plurality of temporal property logs (710) is constructed. For a given well depth (212) and property (or LWD tool measurement), a temporal property log indicates the time-ordered measured values of said property at the given well depth (212). In Block 914, zero or more data points are removed from each temporal property log in the plurality of temporal property logs (710). Data points are identified according to the time at which they were measured and the associated determined drilling event. For example, in one or more embodiments, temperature data points recorded during drilling fluid (112) circulation events are removed from the plurality of temporal property logs (710).

In Block 916, the plurality of temporal property logs (710) is processed with a second machine-learned model (714) to form a plurality of corrected temporal property logs (716). In one or more embodiments, the measured values in the plurality of temporal property logs (716) have been adjusted to account for time-dependent behavior, environmental effects, drilling events, and historical drilling events. As such, the plurality of corrected temporal property logs is aggregated to form high fidelity LWD logs (722), as shown in Block 920. In one or more embodiments, at each well depth (212) the measured values of a given property (or quantity measured by an LWD tool) are averaged to form a high fidelity LWD log of that property. The high fidelity LWD logs (722) are distinct from conventional LWD logs (200) because they make use of all the data acquired by the LWD tools as opposed to only using the first measured value with respect to time at each well depth (212). In Block 922, the high fidelity LWD logs (722) are used to determine petrophysical properties of the subsurface near the wellbore (102). For example, in one or more embodiments, the lithology of the subsurface is determined using, at least in part, the high fidelity LWD logs (722).

Figure 9B:
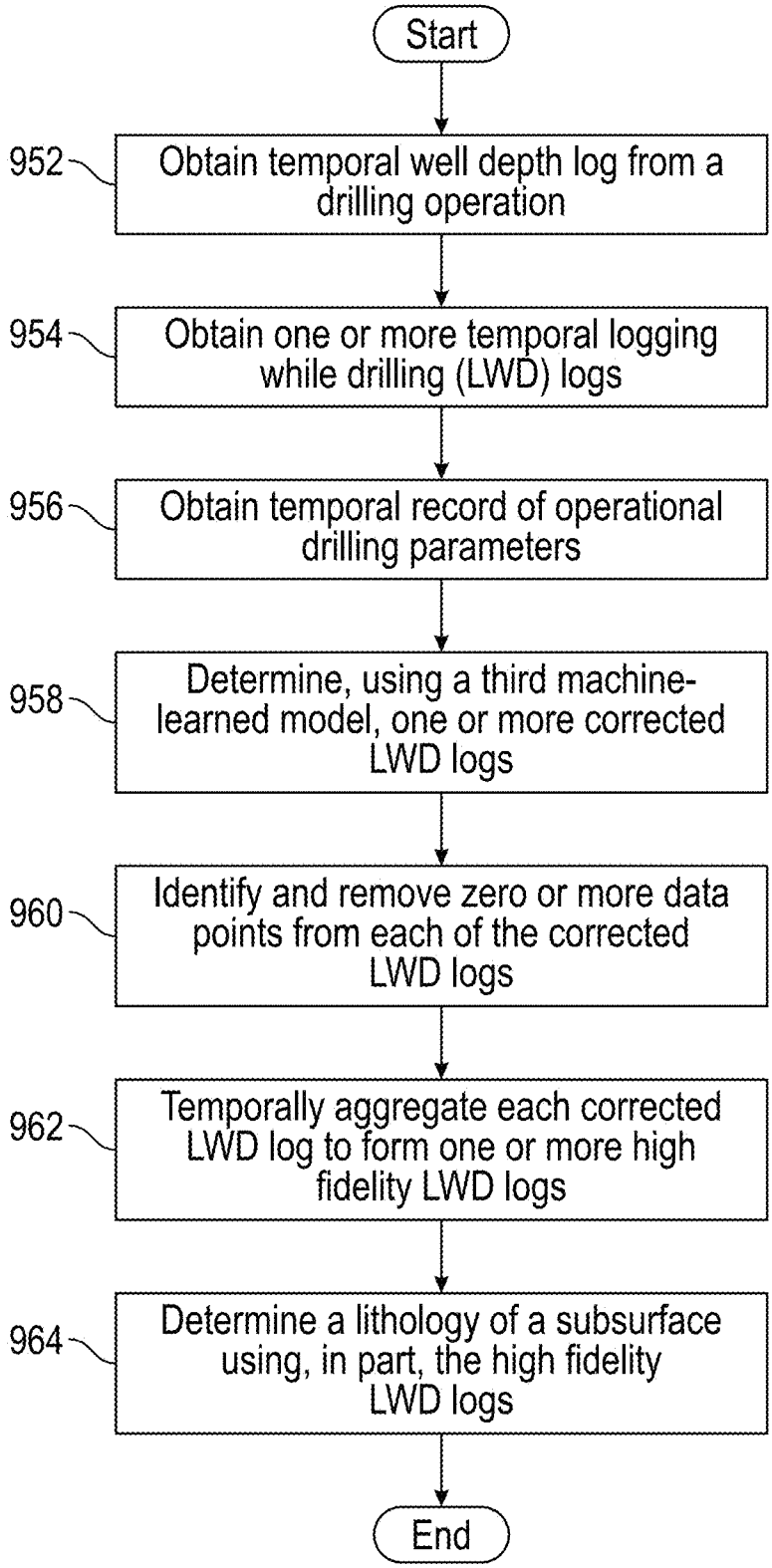
FIG. 9B depicts a flowchart in accordance with one or more embodiments.

In accordance with one or more embodiments, FIG. 9B depicts a flowchart generally outlining the process of constructing high fidelity LWD logs (730) and using these logs for enhanced petrophysical interpretation of the subsurface near the wellbore (102). In Block 952, a temporal well depth log (701) is obtained from a drilling operation. The temporal well depth log (701) indicates the time history of the well depth (212) of the drill bit (110) while drilling during the drilling operation. Additionally, as shown in Blocks 954 and 956, one or more temporal logging while drilling (LWD) logs (702) and a temporal record of operational drilling parameters (704) are obtained, respectively, for the drilling operation. The one or more temporal LWD logs (752) indicate the measured values of one or more LWD tools throughout the period of drilling. Likewise, the temporal record of operational drilling parameters (704) indicates the values of one or more drilling parameters throughout the drilling operation.

In Block 958, using a third machine-learning model, the measured values of each of the one or more temporal LWD logs are corrected based on the temporal well depth log and the temporal record of operational drilling parameters to form one or more corrected LWD logs. In Block 60, zero or more data points are removed from each corrected LWD logs. Data points may be identified using physics-informed constraints (e.g., a non-negative bound).

In Block 962, each of the corrected LWD logs is temporally aggregated to form high fidelity LWD logs. In one or more embodiments, at each well depth (212) the measured values of a given property (or quantity measured by an LWD tool) are averaged to form a high fidelity LWD log of that property. The high fidelity LWD logs are distinct from conventional LWD logs (200) because they make use of all the data acquired by the LWD tools as opposed to only using the first measured value with respect to time at each well depth (212). In Block 964, the high fidelity LWD logs are used to determine petrophysical properties of the subsurface near the wellbore (102). For example, in one or more embodiments, the lithology of the subsurface is determined using, at least in part, the high fidelity LWD logs (722).

While one or more embodiments have been presented herein using the context of logging while drilling (LWD), it is emphasized that the methods described herein may be readily applied to coiled tubing LWD, TLC wireline passes, or multi-purpose logging passes (e.g., where logging tools are traveling along with a tool performing discrete station measurements, such as a formation sampler or formation pressure measurement tool).

Embodiments of the instant disclosure provide for one or more of the following advantages. Using the plurality of corrected temporal property logs (716), a hydrocarbon quick-look log may be constructed and processed differentially. The hydrocarbon quick-look log depicts the sweeping away of the hydrocarbons by drilling fluid (112) invasion. The hydrocarbon quick-look log may be constructed by plotting resistivity values with respect to time at a series of well depths (212). The hydrocarbon quick-look log may then be used in turn to highlight and calibrate changes in shallow resistivity or shallow NMR. Further, the plurality of corrected temporal property logs (716) may be used to improve $R_t$ (true formation resistivity) inversion using multi-depth resistivity array data. Additionally, certain logging tools, such as multi-pole sonic logging tools or pulsed-NMR logging tools, have highly configurable excitation modes and may intentionally be logged across the target reservoir in multiple successive logging passes while being configured into different transmitter modes so as to perform significantly different target measurements in the various passes. While there exist efficient ways to combine and display such deliberately multi-pass log acquisitions, the motion in LWD acquisition mode is rarely as perfectly regular from pass to pass as in a wireline acquisition, due to the vagaries and surprises of the drilling process and because the freshly-drilled subsurface is also undergoing rapid changes at drilling time, due to drilling fluid (112) invasion, near wellbore formation stress redistribution, hole swelling, temperature equilibration, etc.

The machine-learned models presented herein are capable of interpreting and correcting repeat-pass data acquired even in the presence of drilling events and irregularities. As such, the corrected data can be used to improve the self-consistent interpretation of intentionally multi-pass and repeat LWD logging acquisitions, as well as in updating property values that are rapidly evolving in time due to drilling-related perturbations such as mud filtrate invasion. Further, formation properties such as permeability or relative permeability as a function of saturation may be characterized (718) from the corrected temporal property logs (716). Aggregation of the corrected temporal property logs allows for measured values to be averaged over multiple passed of the LWD tools over a given well depth (212). Aggregation, such as averaging, improves the precision of the measured values. Further advantages include detecting changes in subsurface formation (106) properties due to fine particle invasion, drilling-induced formation fracturing, and borehole diameter or shape changes. For example, by comparing the shallowest density measurement on different passes of the LWD tools at a given well depth (212) may indicate fine particle invasion via a notable drop in the computed porosity. Shallow NMR measurements can also show decreased relaxation times as a result of fine particle invasion. A decrease in drilling fluid (112) returns can be a gross indicator of formation fracturing. Finer fracturing can be indicated by an increase in porosity from shallow density measurements, changes in shallow NMR relaxation times (increasing), as well as changes in resistivity measurements (for example, increasing the induction resistivity due to oil-base mud invading into radial fractures). These changes are better highlighted when using corrected temporal property logs. Finally, wellbore (102) constriction can, in an extreme case, show up as an increase in surface torque (an operational drilling parameter). However, it can also show up as a shift in borehole fluid corrections for density or resistivity readings.

Figure 10:
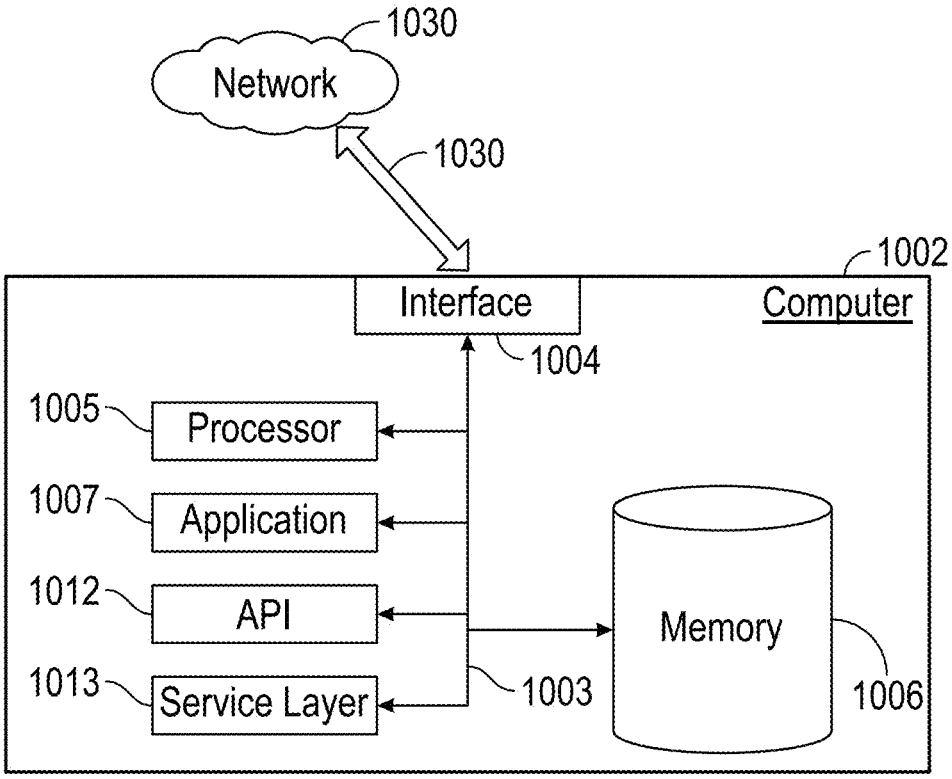
FIG. 10 shows a computer system in accordance with one or more embodiments.

FIG. 10 further depicts a block diagram of a computer system (1002) used to provide computational functionalities associated with the algorithms, methods, functions, processes, flows, and procedures as described in this disclosure, according to one or more embodiments. The illustrated computer (1002) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (1002) may include a computer that includes an input device, such as a keypad, keyboard, touch screen, or other device that can accept user information, and an output device that conveys information associated with the operation of the computer (1002), including digital data, visual, or audio information (or a combination of information), or a GUI.

The computer (1002) can serve in a role as a client, network component, a server, a database or other persistency, or any other component (or a combination of roles) of a computer system for performing the subject matter described in the instant disclosure. In some implementations, one or more components of the computer (1002) may be configured to operate within environments, including cloud-computing-based, local, global, or other environment (or a combination of environments).

At a high level, the computer (1002) is an electronic computing device operable to receive, transmit, process, store, or manage data and information associated with the described subject matter. According to some implementations, the computer (1002) may also include or be communicably coupled with an application server, e-mail server, web server, caching server, streaming data server, business intelligence (BI) server, or other server (or a combination of servers).

The computer (1002) can receive requests over network (1030) from a client application (for example, executing on another computer (1002) and responding to the received requests by processing the said requests in an appropriate software application. In addition, requests may also be sent to the computer (1002) from internal users (for example, from a command console or by other appropriate access method), external or third-parties, other automated applications, as well as any other appropriate entities, individuals, systems, or computers.

Each of the components of the computer (1002) can communicate using a system bus (1003). In some implementations, any or all of the components of the computer (1002), both hardware or software (or a combination of hardware and software), may interface with each other or the interface (1004) (or a combination of both) over the system bus (1003) using an application programming interface (API) (1012) or a service layer (1013) (or a combination of the API (1012) and service layer (1013). The API (1012) may include specifications for routines, data structures, and object classes. The API (1012) may be either computer-language independent or dependent and refer to a complete interface, a single function, or even a set of APIs. The service layer (1013) provides software services to the computer (1002) or other components (whether or not illustrated) that are communicably coupled to the computer (1002). The functionality of the computer (1002) may be accessible for all service consumers using this service layer. Software services, such as those provided by the service layer (1013), provide reusable, defined business functionalities through a defined interface. For example, the interface may be software written in JAVA, C++, or other suitable language providing data in extensible markup language (XML) format or another suitable format. While illustrated as an integrated component of the computer (1002), alternative implementations may illustrate the API (1012) or the service layer (1013) as stand-alone components in relation to other components of the computer (1002) or other components (whether or not illustrated) that are communicably coupled to the computer (1002). Moreover, any or all parts of the API (1012) or the service layer (1013) may be implemented as child or sub-modules of another software module, enterprise application, or hardware module without departing from the scope of this disclosure.

The computer (1002) includes an interface (1004). Although illustrated as a single interface (1004) in FIG. 10, two or more interfaces (1004) may be used according to particular needs, desires, or particular implementations of the computer (1002). The interface (1004) is used by the computer (1002) for communicating with other systems in a distributed environment that are connected to the network (1030). Generally, the interface (1004) includes logic encoded in software or hardware (or a combination of software and hardware) and operable to communicate with the network (1030). More specifically, the interface (1004) may include software supporting one or more communication protocols associated with communications such that the network (1030) or interface's hardware is operable to communicate physical signals within and outside of the illustrated computer (1002).

The computer (1002) includes at least one computer processor (1005). Although illustrated as a single computer processor (1005) in FIG. 10, two or more processors may be used according to particular needs, desires, or particular implementations of the computer (1002). Generally, the computer processor (1005) executes instructions and manipulates data to perform the operations of the computer (1002) and any algorithms, methods, functions, processes, flows, and procedures as described in the instant disclosure.

The computer (1002) also includes a memory (1006) that holds data for the computer (1002) or other components (or a combination of both) that can be connected to the network (1030). The memory may be a non-transitory computer readable medium. For example, memory (1006) can be a database storing data consistent with this disclosure. Although illustrated as a single memory (1006) in FIG. 10, two or more memories may be used according to particular needs, desires, or particular implementations of the computer (1002) and the described functionality. While memory (1006) is illustrated as an integral component of the computer (1002), in alternative implementations, memory (1006) can be external to the computer (1002).

The application (1007) is an algorithmic software engine providing functionality according to particular needs, desires, or particular implementations of the computer (1002), particularly with respect to functionality described in this disclosure. For example, application (1007) can serve as one or more components, modules, applications, etc. Further, although illustrated as a single application (1007), the application (1007) may be implemented as multiple applications (1007) on the computer (1002). In addition, although illustrated as integral to the computer (1002), in alternative implementations, the application (1007) can be external to the computer (1002).

There may be any number of computers (1002) associated with, or external to, a computer system containing computer (1002), wherein each computer (1002) communicates over network (1030). Further, the term "client," "user," and other appropriate terminology may be used interchangeably as appropriate without departing from the scope of this disclosure. Moreover, this disclosure contemplates that many users may use one computer (1002), or that one user may use multiple computers (1002).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method, comprising:

obtaining a temporal well depth log and a plurality of temporal logging while drilling (LWD) logs from a drilling operation, wherein the drilling operation comprises a drill bit traversing through a subsurface at a plurality of depths;

obtaining a temporal record of operational drilling parameters from the drilling operation;

determining, using a first machine-learning model, a temporal history of the drilling operation, wherein the first machine-learning model accepts, at least in part, the temporal well depth log and the temporal record of operational drilling parameters;

constructing, using the temporal well depth log and the plurality of temporal LWD logs, a plurality of temporal property logs at each depth in the plurality of depths, wherein each temporal property log comprises a plurality of data points;

identifying and removing outlier data points from each of the temporal property logs based on the temporal history;

processing the plurality of temporal property logs with, at least, a second machine-learning model to form a plurality of corrected temporal property logs;

aggregating the plurality of corrected temporal property logs to form a plurality of high fidelity LWD logs; and determining a lithology of the subsurface using, at least in part, the plurality of high fidelity LWD logs.

2. The method of claim 1, further comprising:

characterizing a plurality of formation properties of the subsurface with respect to a passage of time using the plurality of corrected temporal property logs.

3. The method of claim 1, further comprising:

generating a hydrocarbon quick-look log depicting a time-lapse invasion of drilling fluid.

4. The method of claim 1, further comprising:

determining, using the temporal well depth log, a velocity profile of the drill bit and processing the plurality of high fidelity LWD logs with a locally adaptive filter, wherein the locally adaptive filter is adapted according to the velocity profile.

5. The method of claim 1, wherein the temporal history comprises temporally ordered drilling events as classified by the first machine-learning model.

6. The method of claim 5, wherein a drilling event is one or more of the following: a drill string connection event, a drilling fluid circulation event, a pause in drilling activity.

7. The method of claim 1, wherein the first machine-learning model and second machine-learning model are deep neural networks.

8. A non-transitory computer-readable memory comprising computer-executable instructions stored thereon that, when executed on a processor, cause the processor to perform:

receive a temporal well depth log and a plurality of temporal logging while drilling (LWD) logs from a drilling operation, wherein the drilling operation comprises a drill bit traversing through a subsurface at a plurality of depths;

receive a temporal record of operational drilling parameters from the drilling operation;

determine, using a first machine-learning model, a temporal history of the drilling operation, wherein the first machine-learning model accepts, at least in part, the temporal well depth log and the temporal record of operational drilling parameters;

construct, using the temporal well depth log and the plurality of temporal LWD logs, a plurality of temporal property logs at each depth in the plurality of depths, wherein each temporal property log comprises a plurality of data points;

identify and remove outlier data points from each of the temporal property logs based on the temporal history;

process the plurality of temporal property logs with, at least, a second machine-learning model to form a plurality of corrected temporal property logs;

aggregate the plurality of corrected temporal property logs to form a plurality of high fidelity LWD logs; and determine a lithology of the subsurface using, at least in part, the plurality of high fidelity LWD logs.

9. The non-transitory computer-readable memory of claim 8, further comprising computer-executable instructions for:

characterizing a plurality of formation properties of the subsurface with respect to a passage of time using the plurality of corrected temporal property logs.

10. The non-transitory computer-readable memory of claim 8, further comprising computer-executable instructions for:

generating a hydrocarbon quick-look log depicting an invasion of drilling fluid with respect to a passage of time.

11. The non-transitory computer-readable memory of claim 8, further comprising computer-executable instructions for:

determining, using the temporal well depth log, a velocity profile of the drill bit and processing the plurality of high fidelity LWD logs with a locally adaptive filter, wherein the locally adaptive filter is adapted according to the velocity profile.

12. The non-transitory computer-readable memory of claim 8, wherein the temporal history comprises temporally ordered drilling events as classified by the first machine-learning model.

13. The non-transitory computer-readable memory of claim 8, wherein a drilling event is one or more of the following: a drill string connection event, a drilling fluid circulation event, a pause in drilling activity.

14. The non-transitory computer-readable memory of claim 8, wherein the first machine-learning model and second machine-learning model are deep neural networks.

15. A system, comprising:

a well site performing a drilling operation, wherein the drilling operation comprises a drill bit traversing through a subsurface;

a plurality of logging while drilling (LWD) tools configured to measure properties of the subsurface;

a temporal record of operational drilling parameters of the well site;

a temporal well depth log;

a plurality of temporal LWD logs, one for each LWD tool, where each temporal LWD log comprises measurements of an associated property of the subsurface over a period of time;

a first machine-learning model;

a second machine-learning model; and a computer, comprising:

one or more computer processors and a non-transitory computer-readable memory storing computer-executable instructions that when executed on the one or more computer processors cause the one or more compute processors to perform:

receiving the temporal well depth log and the plurality of temporal logging while drilling (LWD) logs;

receiving the temporal record of operational drilling parameters;

determining, using the first machine-learning model, a temporal history of the drilling operation, wherein the first machine-learning model accepts, at least in part, the temporal well depth log and the temporal record of operational drilling parameters;

constructing, using the temporal well depth log and the plurality of temporal LWD logs, a plurality of temporal property logs at each depth in the plurality of depths, wherein each temporal property log comprises a plurality of data points;

identifying and removing outlier data points from each of the temporal property logs based on the temporal history;

processing the plurality of temporal property logs with, at least, the second machine-learning model to form a plurality of corrected temporal property logs;

aggregating the plurality of corrected temporal property logs to form a plurality of high fidelity LWD logs; and determining a lithology of the subsurface using, at least in part, the plurality of high fidelity LWD logs.

16. The system of claim 15, wherein the non-transitory computer-readable further comprises computer-executable instructions for:

characterizing a plurality of formation properties of the subsurface with respect to a passage of time using the plurality of corrected temporal property logs.

17. The system of claim 15, wherein the non-transitory computer-readable further comprises computer-executable instructions for:

generating a hydrocarbon quick-look log depicting an invasion of drilling fluid with respect to a passage of time.

18. The system of claim 15, wherein the non-transitory computer-readable further comprises computer-executable instructions for:

determining, using the temporal well depth log, a velocity profile of the drill bit and processing the plurality of high fidelity LWD logs with a locally adaptive filter, wherein the locally adaptive filter is adapted according to the velocity profile.

19. The system of claim 15, wherein the temporal history comprises temporally ordered drilling events as classified by the first machine-learn model.

20. The system of claim 15, wherein the first machine-learned model and second machine-learned model are deep neural networks.

* * * * *